US007852358B2

(12) United States Patent
Kudo et al.

(10) Patent No.: US 7,852,358 B2
(45) Date of Patent: Dec. 14, 2010

(54) DISPLAY DEVICE WITH CONTROL OF STEADY-STATE CURRENT OF A GENERATION CIRCUIT

(75) Inventors: Yasuyuki Kudo, Kamakura (JP); Atsuhiro Higa, Yokohama (JP); Yoshikazu Yokota, Kodaira (JP); Hiroshi Kurihara, Mobara (JP); Kazunari Kurokawa, Mobara (JP)

(73) Assignee: Hitachi, Ltd., Tokyo (JP)

( * ) Notice: Subject to any disclaimer, the term of this patent is extended or adjusted under 35 U.S.C. 154(b) by 1034 days.

(21) Appl. No.: 11/637,093

(22) Filed: Dec. 12, 2006

(65) Prior Publication Data

US 2007/0085793 A1 Apr. 19, 2007

Related U.S. Application Data

(63) Continuation of application No. 10/823,615, filed on Apr. 14, 2004, now Pat. No. 7,151,549, which is a continuation of application No. 09/960,409, filed on Sep. 24, 2001, now Pat. No. 6,753,880.

(30) Foreign Application Priority Data

Apr. 10, 2001 (JP) ..... 2001-110788

(51) Int. Cl.
*G09G 5/10* (2006.01)

(52) U.S. Cl. ..... 345/690

(58) Field of Classification Search ..... 345/89, 345/96, 98–100, 204, 211, 690, 691; 382/168–172
See application file for complete search history.

(56) References Cited

U.S. PATENT DOCUMENTS 5,323,171 A 6/1994 Yokouchi
5,534,885 A 7/1996 Saitoh
5,617,484 A 4/1997 Wada
5,684,501 A * 11/1997 Knapp et al. ..... 345/94
5,751,834 A 5/1998 Lisk
5,862,254 A 1/1999 Kim
5,937,090 A 8/1999 Kim
5,995,073 A * 11/1999 Isami et al. ..... 345/89
6,166,725 A 12/2000 Osami
6,269,186 B1 7/2001 Makita
6,343,159 B1 1/2002 Cuciurean-Zapan
6,753,880 B2 * 6/2004 Kudo et al. ..... 345/690
7,151,549 B2 * 12/2006 Kudo et al. ..... 345/690

FOREIGN PATENT DOCUMENTS

JP 10-240192 9/1998
JP 10-301541 11/1998

* cited by examiner

*Primary Examiner*—Alexander S Beck
*Assistant Examiner*—Rodney Amadiz
(74) *Attorney, Agent, or Firm*—Antonelli, Terry, Stout & Kraus, LLP.

(57) ABSTRACT

A display device for displaying display data includes a display panel having pixel sections in a matrix form, a scanning circuit which selects a line of the pixel sections, a generation circuit which generates a plurality of gray-scale voltages based on a reference voltage, and a selection circuit which selects a gray-scale voltage corresponding to the display data from the plurality of gray-scale voltages, and outputs the gray-scale voltage thus selected to a pixel section of the display panel. The generation circuit one of increases and decreases a steady-state current of the generation circuit at a second period within one scanning period of the scanning circuit.

7 Claims, 21 Drawing Sheets

| LOAD | OFS | FREQUENCY | CURRENT CONTROL DATA | OUTPUT CURRENT |
|---|---|---|---|---|
| SMALL | 0h | 0~31 | 0h | 10[μA] |
| | | 384 | Ch | 130[μA] |
| LARGE | 3h | 0~31 | 3h | 40[μA] |
| | | 384 | Fh | 160[μA] |

FIG.20

| LOAD | GIN | FREQUENCY | CURRENT CONTROL DATA | OUTPUT CURRENT |
|---|---|---|---|---|
| SMALL | 7h (ONE TIME) | 0~31 | 0h | 10[μA] |
| | | 384 | Ch | 130[μA] |
| LARGE | 9h (1.25 TIMES) | 0~31 | 0h | 12.5[μA] |
| | | 384 | Ch | 162.5[μA] |

DISPLAY DEVICE WITH CONTROL OF STEADY-STATE CURRENT OF A GENERATION CIRCUIT

CROSS-REFERENCE TO RELATED APPLICATIONS

This application is a continuation of application Ser. No. 10/823,615, filed Apr. 14, 2004, now U.S. Pat. No. 7,151,549, which is a continuation of application Ser. No. 09/960,409 filed on Sep. 24, 2001 now U.S. Pat. No. 6,753,880. The contents of application Ser. Nos. 10/823,615 and 09/960,409 are hereby incorporated herein by reference in their entirety.

BACKGROUND OF THE INVENTION

The present invention relates to a display device for displaying input display data, and a display driving circuit for generating a gray-scale voltage according to display data and applying the gray-scale voltage to display elements of a display panel. In particular, the present invention relates to a display device such as a liquid crystal display, a plasma display, and an EL (Electronic luminescence) display, and its display driving circuit.

As for conventional techniques, a conventional liquid crystal driving circuit is disclosed in JP-A-10-240192. This liquid crystal driving circuit generates a gray-scale voltage group of a plurality of levels by conducting resistor division on reference voltages of a plurality of levels by use of string resistors, selects one voltage from among the generated gray-scale voltage group according to input display data, and outputs the selected gray-scale voltage. The reference voltages of the JP-A-10-240192 are stabilized by buffer circuits using amplifiers.

In JP-A-10-301541, there is disclosed a liquid crystal driving circuit of gray-scale voltage selection type. This liquid crystal driving circuit converts a digital video signal to 16 gray-scale levels by using a decoder, inputs decoded outputs of respective colors to counters via OR gates provided respectively for gray-scale levels, counts the number of times of writing each gray-scale level in one horizontal scanning interval, selects one of current sources according to the number of times by means of a selection switch, and supplies the selected current source to a gray-scale voltage output buffer as its bias current. As a result, only a minimum required driving current according to input display data can be flown on each occasion. Therefore, a higher efficiency and a low power consumption can be realized.

In the aforementioned JP-A-10-240192, a certain constant steady-state current is flown through the buffer circuit and the string resistors so as to be able to conduct driving no matter which gray-scale voltage assumes all selection state. The steady-state current is not required for gray-scale voltages that are not selected. If a constant steady-state current is always flown through every buffer circuit and string resistors, therefore, the efficiency is lowered.

In the aforementioned JP-A-10-301541, display data are input continuously. Therefore, it is necessary to always conduct operation of calculating the number of times of selection of each graduation voltage. As a result, the power consumption of a computation circuit portion is excessively large.

SUMMARY OF THE INVENTION

An object of the present invention is to provide such a display device and a display driving circuit thereof that power consumption can be reduced by making the steady-state currents efficient or reducing the operation frequency.

In accordance with the present invention, a display device or a display driving device includes a display memory for storing display data; a histogram memory for storing frequencies of gray-scale voltages every line; and a gray-scale voltage generation circuit for generating a plurality of gray-scale voltages on the basis of reference voltages, a current quantity of a circuit for generating each of the plurality of gray-scale voltages being changed according to a frequency of the gray-scale voltage.

Furthermore, in accordance with the present invention, a display device or a display driving device includes a detection circuit for detecting a current quantity of each of gray-scale voltages to be applied to a display panel, and calculating frequencies of the gray-scale voltages every line; a histogram memory for storing frequencies of gray-scale voltages; and a gray-scale voltage generation circuit for generating a plurality of gray-scale voltages on the basis of reference voltages, a current quantity of a circuit for generating each of the plurality of gray-scale voltages being changed according to a frequency of the gray-scale voltage.

According to the present invention, there is brought about an effect that power consumption can be reduced by making the steady-state currents efficient or reducing the operation frequency.

BRIEF DESCRIPTION OF THE DRAWING

FIG. 20 is a diagram showing a configuration of a gray-scale voltage generation section according to a sixth embodiment of the present invention;

DESCRIPTION OF THE EMBODIMENTS

A liquid crystal driving circuit in the present invention has such a configuration as to generate a gray-scale voltage group by conducting resistor division on reference voltages, select one voltage from among the generated gray-scale voltage group according to input display data, and output the selected gray-scale voltage. As for its feature, the liquid crystal driving circuit in the present invention includes a display memory for storing input display data, a histogram detection section for detecting display frequencies (hereafter referred to as histogram) of respective gray-scales on an arbitrary scanning line from display data of the scanning line transferred from the display memory, a histogram memory for storing histogram data of all scanning lines, and a gray-scale voltage generation section for controlling steady-state currents that flow through buffer circuits and string resistors according to the histogram data transferred from the histogram memory.

In the aforementioned configuration, the liquid crystal driving circuit of the present invention previously derives a histogram, which indicates selection frequencies of respective gray-scale voltages, and controls the steady-state currents that flow through the buffer circuits and the string resistors, according to the data. As a result, only the minimum required driving current according to the input display data can be flown on each occasion. Therefore, a higher efficiency and a low power consumption can be realized. Furthermore, since means for storing histogram data corresponding to all lines has been provided, the histogram detection operation becomes unnecessary unless the data of the display memory is updated. Accordingly, it becomes possible to lower the operation frequency of the circuit, and lower power consumption can be attained.

First Embodiment

Figure 1:
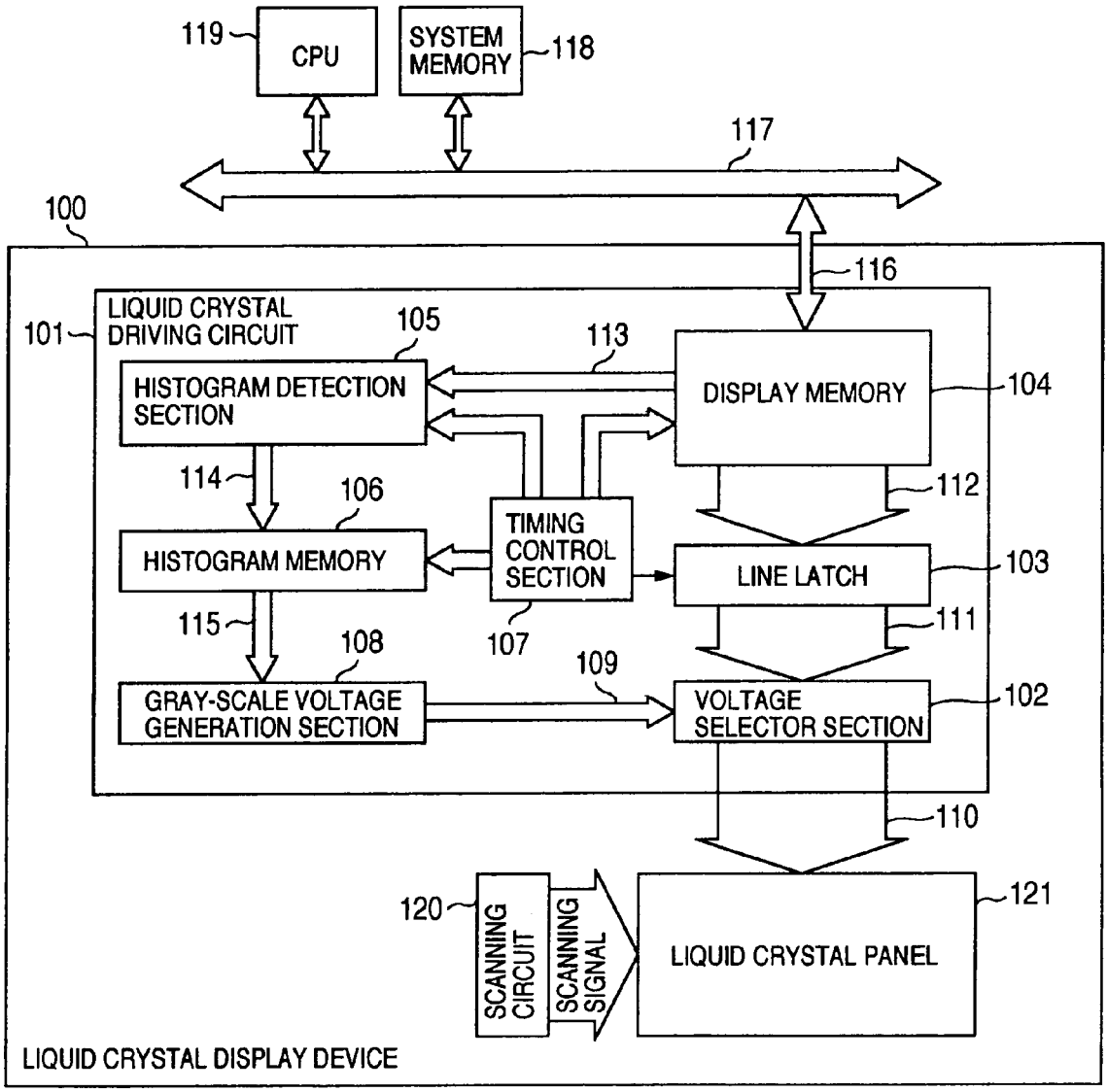
FIG. 1 is a diagram showing a schematic configuration of a liquid crystal driving circuit according to a first embodiment of the present invention.

Hereafter, a configuration and operation of a liquid crystal driving circuit according to an embodiment of the present invention will be described by referring to FIGS. 1 to 10. First, the configuration of the whole liquid crystal driving circuit according to the present embodiment will now be described. In FIG. 1, numeral 101 denotes a liquid crystal driving circuit, 102 a voltage selector section, 103 a line latch, 104 a display memory, 105 a histogram detection section, 106 a histogram memory, 107 a timing control section, 108 a gray-scale voltage generation section, 109 a gray-scale voltage group, 110 an output terminal group, 111 latch data, 112 and 113 display data, and 114 and 115 histogram data.

The liquid crystal display device 100 includes a liquid crystal panel 121 having pixels (display elements) arranged in a matrix form (having, for example M columns and N rows), a liquid crystal driving circuit 101 for applying a gray-scale voltage depending upon input display data, a scanning circuit 120 for scanning lines of pixels to which a gray-scale voltage is applied, and an interface for inputting display data supplied from an external system (such as, for example, a computer or a TV tuner). The liquid crystal display device 100 includes a plurality of liquid crystal driving circuits 101 (for example, LSIs) and a plurality of scanning circuits (for example, LSIs) for one liquid crystal panel 121. The scanning circuit 120 selects a pixel line according to a timing signal generated by a timing control section 107.

The liquid crystal driving circuit 101 according to the present embodiment includes the display memory 104 for storing display data, the line latch 103 for temporarily storing the display data 112 corresponding to one line output by the display memory 104, the histogram detection section 105 for receiving the display data 113 serially output from the display memory 104 and detecting a histogram, the gray-scale voltage generation section 108 for controlling a steady-state current quantity of the circuit according to the histogram data 114 generated by the histogram detection section 105 and at the same time outputting respective gray-scale voltages, the voltage selector section 102 for selecting one level from among a group of gray-scale voltages 109 output by the gray-scale voltage generation section 108, by means of the latch data 111 output by the line latch 103 and outputting the selected level to the output terminal group 110, and the timing control section 107 for generating a timing signal group to direct operation timing of the aforementioned blocks.

An outline of operation of the liquid crystal driving circuit 101 according to the first embodiment of the present invention will now be described.

In the display memory 104, as many display data as the number of pixels (for example, M×N) of the liquid crystal panel 121 are stored. For example, if the resolution of the liquid crystal panel 121 is 128 dots×RGB in the horizontal direction and 176 lines in the vertical direction and display of 64 gray-scales and 262,144 colors is conducted, then the capacity of the display memory is 405,504 bits because information of 6 bits is required for each pixel. In the case where the display contents are to be altered, display data of the display memory 104 are updated by the CPU 119 or the like via the data bus 117. Since the display memory 104 receives the display data directly from the data bus 117, the display memory 104 serves as an input circuit. Typically, the liquid crystal driving circuit conducts the display operation asynchronously with access of the CPU 119. Since the liquid crystal driving circuit includes the display memory 194, the liquid crystal driving circuit does not conduct external access while the display data is not being updated. As a result, the power consumption is reduced. And from the display memory 104, the display data 112 corresponding to one line are read out in order beginning with a scanning line of the head. After the final line, readout from the head line is repeated again. This operation can be implemented by the timing control section 107 specifying a read address. The display data 112 is stored temporarily in the line latch 103. Typically, display data readout access to the display memory 104 and access of the CPU 119 to the display memory 104 are exclusive and asynchronous. In order to make the display data readout access time as short as possible, therefore, there is provided the line latch 103. And the latch data 111 is output to the voltage selector section 102. Incidentally, the timing control section 107 may be disposed inside the liquid crystal display device 100 and outside the liquid crystal driving circuit 101.

On the other hand, the display memory 104 transfers display data 113 of a scanning line specified by the timing control section 107 to the histogram detection section 105 serially one pixel at a time or several pixels at a time. Here, the timing control section 107 directs a readout address of the memory so as to transfer, for example, display data corresponding to all scanning lines the first one time after turning on power and thereafter transfer display data on scanning lines for which contents of the display memory 104 have been rewritten.

Figure 9A:
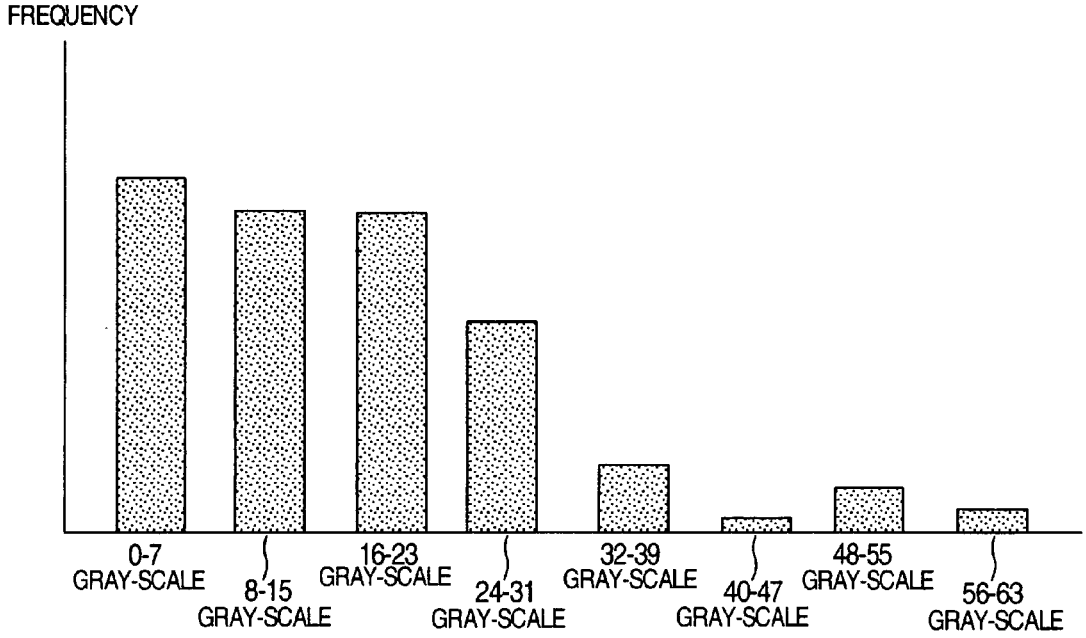
FIGS. 9A-9B are diagrams showing a histogram according to a first embodiment of the present invention.
Figure 9B:
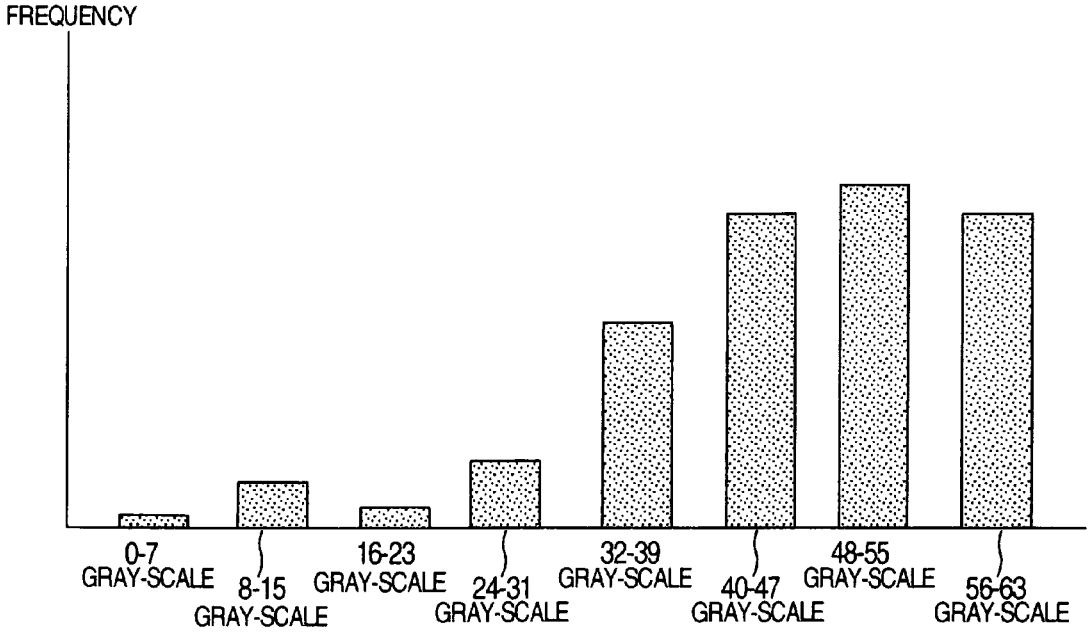

The histogram detection section 105 detects a histogram corresponding to one line having gray-scale as a rank from the display data 113. In other words, by detecting the histogram, it is possible to know display frequencies of respective gray-scales and it is possible to know how many data lines of the liquid crystal panel 121 are driven. Frequencies of respective gray-scales corresponding to one line obtained by the histogram detection section 105 are output as the histogram data 114. As for histogram data, it is also possible to divide gray-scales into some groups, for example, as shown in FIGS. 9A and 9B by considering the circuit scale and so on, and detect frequencies of respective groups. Furthermore, histogram data of each group can assume a value in the range of 0 to 384 (=128 horizontal dots×RGB), and consequently it becomes data of 9 bits. By considering the circuit scale and so on, however, several high-order bits may be output as the histogram data 114.

Subsequently, in the histogram memory 106, the histogram data 114 is stored in a predetermined address provided for each scanning line. Here, the predetermined address corresponds to the position of a scanning line from which the histogram data has been detected, and address specification is conducted by the timing control section 107. And the histogram data 115 is read out in order beginning with the head scanning line. The readout address in this operation coincides with the address used when reading out the display data 112 from the display memory 104, and the readout address is directed by the timing control section 107.

Subsequently, the gray-scale voltage generation section 108 generates the gray-scale voltage group 109 and outputs the gray-scale voltage group 109 to the voltage selector section 102. The gray-scale voltage group 109 is generated by conducting resistor division on reference voltages stabilized by buffer circuits, by use of string resistors. However, the bias currents of the buffer circuits and the steady-state current that flow through string resistors change according to the histogram data 115. For example, if values of the histogram data 115 are great, then the number of driven data lines of the liquid crystal panel 121 is great. In this case, therefore, the bias current quantity is increased and the string resistor values are made small to raise the driving capability. If in contrast with this values of the histogram data are small, then the number of driven data lines of the liquid crystal panel 121 is small. In this case, therefore, the bias current quantity is reduced and the string resistor values are made large to lower the driving capability.

In the voltage selector section 102, one voltage level is selected from among the gray-scale voltage group 109 every pixel according to the latch data 111. The selected voltage level is output to the output terminal group 110 to drive data lines of the liquid crystal panel 121. And in the liquid crystal panel 121, display corresponding to the display data is conducted on a pixel of the scanned line in accordance with a scanning signal output by the scanning circuit 120 and a gray-scale voltage output by the output terminal group 110.

A detailed configuration and operation of the histogram detection section 105 will now be described by referring to FIGS. 2 and 3. First, it is now assumed that the histogram data 114 output by the histogram detection section 105 is divided into eight groups for gray-scales 0-7, 8-15, 16-23, 24-31, 32-39, 40-47, 48-55 and 56-63, and each group has information of four bits. Furthermore, it is assumed that the display data 113 corresponding to three pixels: R (red), G (green) and B (blue) are read out simultaneously from the display memory 104 and this is repeated by 128 cycles to read out one-line data of 384 pixels. For each pixel, gray-scale information corresponding to 6 bits (64 gray-scales) is stored in the display memory 104. However, data actually read out is determined to be three high-order bits. The reason is that a histogram of each group can be detected by using three high-order bits in the aforementioned eight group distribution.

Figure 2:
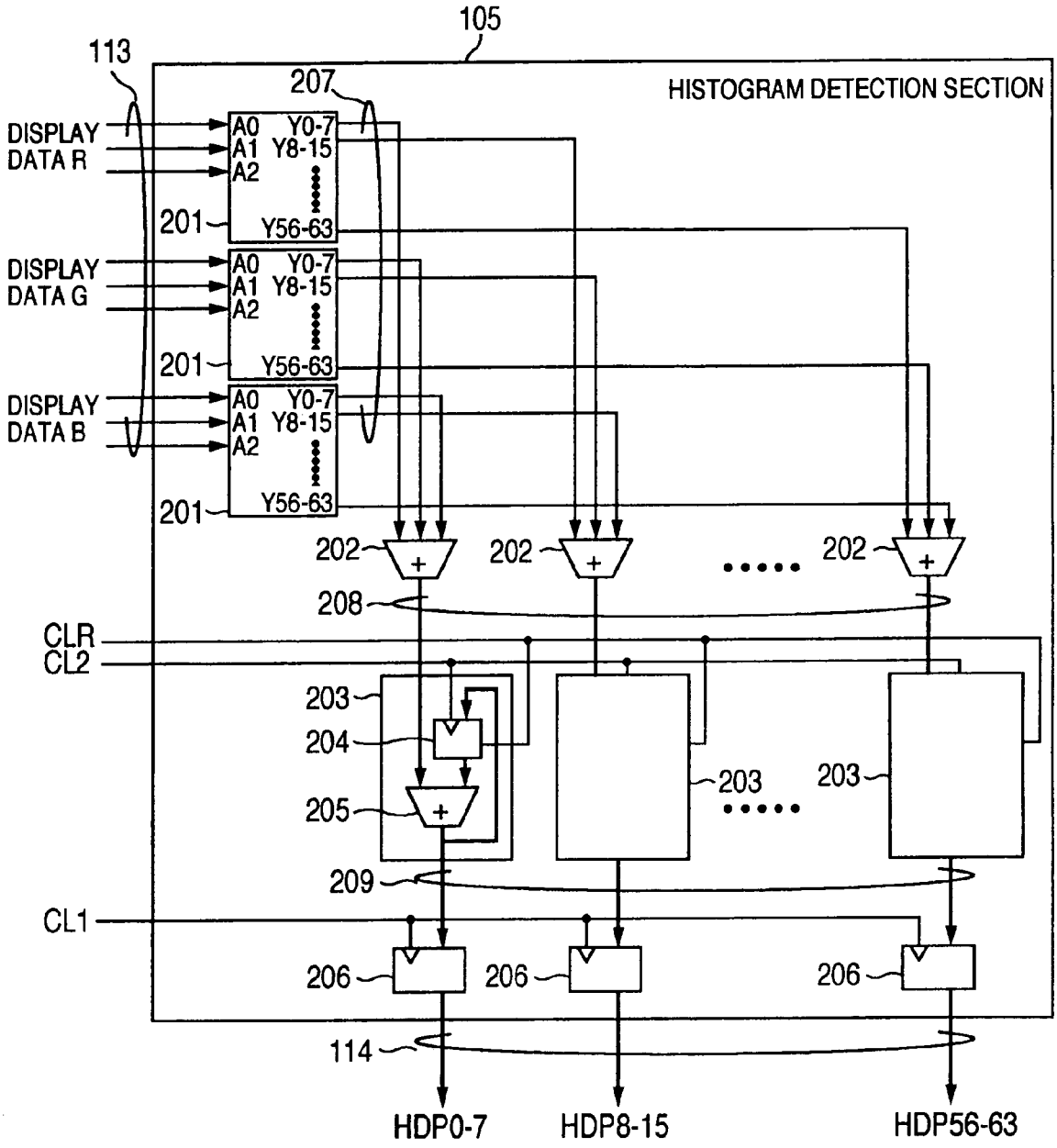
FIG. 2 is a diagram showing a configuration of a histogram detection section according to a first embodiment of the present invention.
Figure 3:
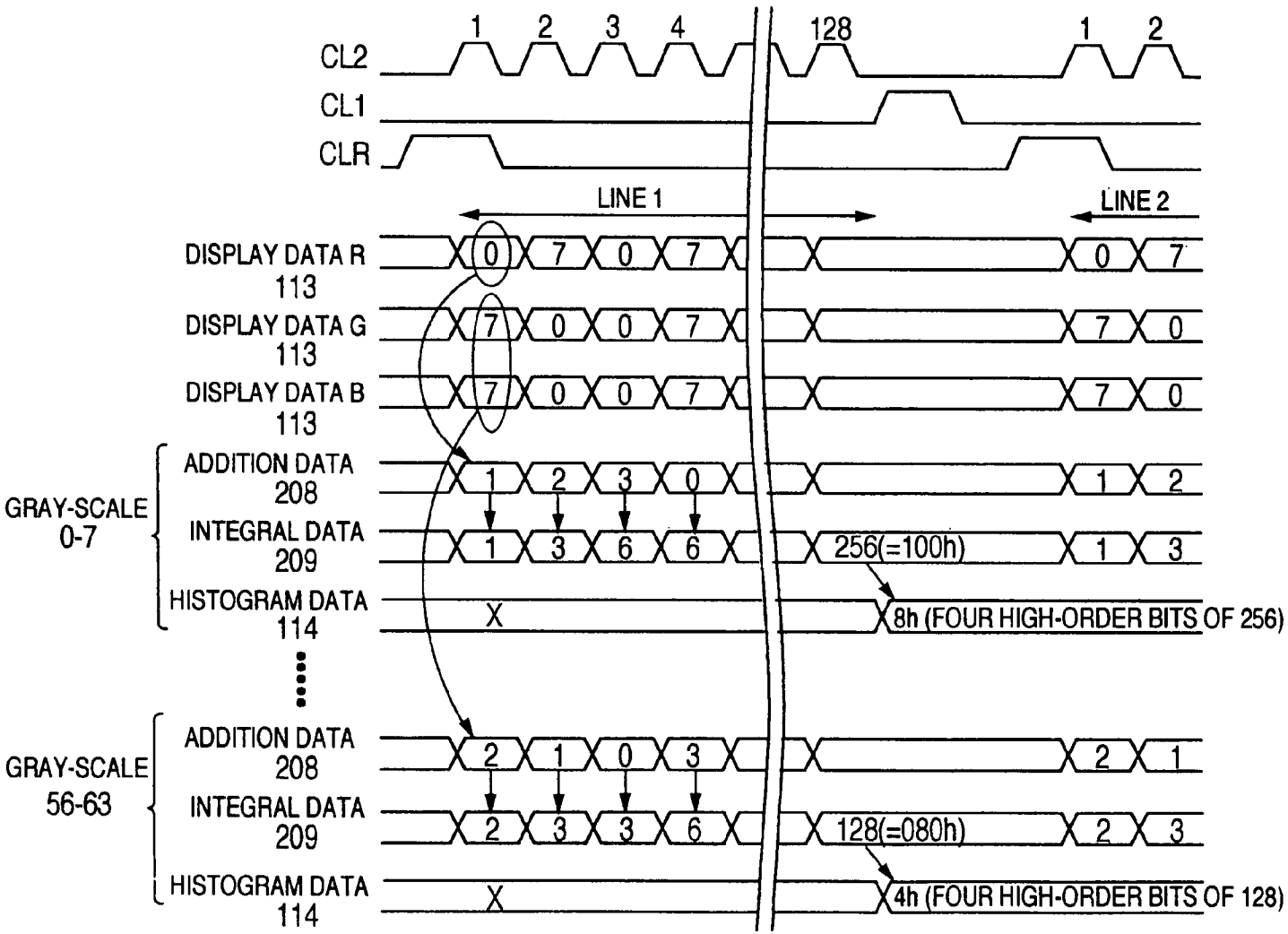
FIG. 3 is a diagram showing operation of a histogram detection section according to a first embodiment of the present invention.

In FIG. 2, numeral 201 denotes a decoder, 202 an adder, 203 a counter circuit, 204 a latch, 205 an adder, 206 a latch, 207 a decode signal, 208 addition data, 209 integral data, CL2 a dot clock, CL1 a line clock, and CLR a clear signal. The same elements as those of FIG. 1 are denoted by like numerals. First, the histogram detection section 105 includes the decode circuits 201 for decoding decoding the display data 113, the adders 202 for counting the number of "H"s of the decode signal 207 and generating the addition data 208, the counter circuits 203 for integrating the addition data 208, and the latches 206 for holding four high-order bits of the integral data 209 corresponding to one line as the histogram data 114. Each counter circuit 203 includes the latch 204 for latching the integral data 209, and the adder 205 for adding latched data and the addition data 208 and generating the integral data 209.

Operation of the histogram detection 105 will now be described by referring to FIG. 3. For simplifying the description, it is now assumed that display data includes only gray-scale 0 (three high-order bits=0) and gray-scale 63 (three high-order bits=7). First, as shown in FIG. 3, the display data 113 is read out from the display memory 104 in accordance with the dot clock CL2. As for R, G and B of the display data 113, three bits are converted to eight decode signals 207 by respectively corresponding decoders 201. Addition data 208 of respective gray-scales are derived from the decode signals by the adders 202. When the display data 113 of a first cycle are "0", "7" and "7" as shown in FIG. 3, Y0-7 of the display data R, Y56-63 of the display data G, and Y56-63 of the display data B are made "H" by the decoders 201. Therefore, the addition data of gray-scale 0-7 becomes "1", the addition data of gray-scale 56-63 becomes "2", and all of other gray-scales become "0". Since three pixels are read out simultaneously in the present example, the addition data 208 can assume a value in the range of 0 to 3. In this way, the addition data 208 are generated. In the case of the display data 113 as shown in FIG. 3, the addition data 208 of the gray-scale 0-7 becomes "1", "2", "3", "0", . . . , in order, and the addition data 208 of the gray-scale 56-63 becomes "2", "1", "0", "3", . . . , in order. Subsequently, the addition data 208 are integrated by the counter circuits 203. In the counter circuits 203, the latches 204 are first cleared to "0" by the clear signal CLR. Furthermore, data of the latch 204 and the addition data 208 are added by the adder 205. As shown in FIG. 3, therefore, the integral data 209 of the first cycle of the gray-scale 0 becomes "1", and the integral data 209 of the first cycle of the gray-scale 63 becomes "2". Subsequently, in the second cycle, the integral data 209 of the first cycle is first latched by the latch 204 and delayed by one cycle. The integral data of the first cycle delayed by one cycle and the addition data 208 of the second cycle are added by the adder 205 in the same way as the first cycle to generate the integral data of the second cycle. As shown in FIG. 3, therefore, the integral data 209 of the second cycle of the gray-scale 0 becomes "3" and the integral data 209 of the second cycle of the gray-scale 63 becomes "3". By repeating this by 128 cycles, integral data corresponding to one line for each gray-scale, i.e., the frequency of each gray-scale can be found. In the present example, it is assumed that the final integral data 209 of the gray-scale 0 is "256" and the final integral data 209 of the gray-scale 63 is "128". By the way, in the present example, 384 pixels are read out per line. Therefore, the integral data 209 can assume a value in the range of 0 to 384. Accordingly, the integral data 209 becomes 9-bit data. Subsequently, the integral data 209 is latched in the latch 206 by the line clock CL1 and output as the histogram data 114. By the way, as for the line clock CL1, its pulse is input after the display data corresponding to one line are read out and the integral data corresponding to one line have been fixed. In the present example, four high-order bits of the integral data 209 are latched and output as the histogram data 114 as shown in FIG. 3. As a matter of course, it doesn't matter if all bits are latched. Even if several high-order bits are latched with due regard to the circuit scale and so on, however, lower power consumption can be achieved. Since the integral data 209 of the gray-scale 0-7 is "256" as shown in FIG. 3, the histogram 114 becomes "8h" (hereafter, suffix h represents a hexadecimal degit). Since the integral data 209 of the gray-scale 56-63 is "128", the histogram 114 becomes "4h". Furthermore, after the histogram 114 has been generated by the line clock CL1, the latches 204 are cleared by the clear signal CLR in order to generate integral data of the second line as the integral data 209. It is assumed that the signals CL1, CL2 and CLR are generated by the timing control section 107 and transferred. As heretofore described, the histogram detection section 105 can detect the histogram from the display data 113 and generate histogram data 114 proportionate to the number of display lines of each gray-scale.

Figure 4:
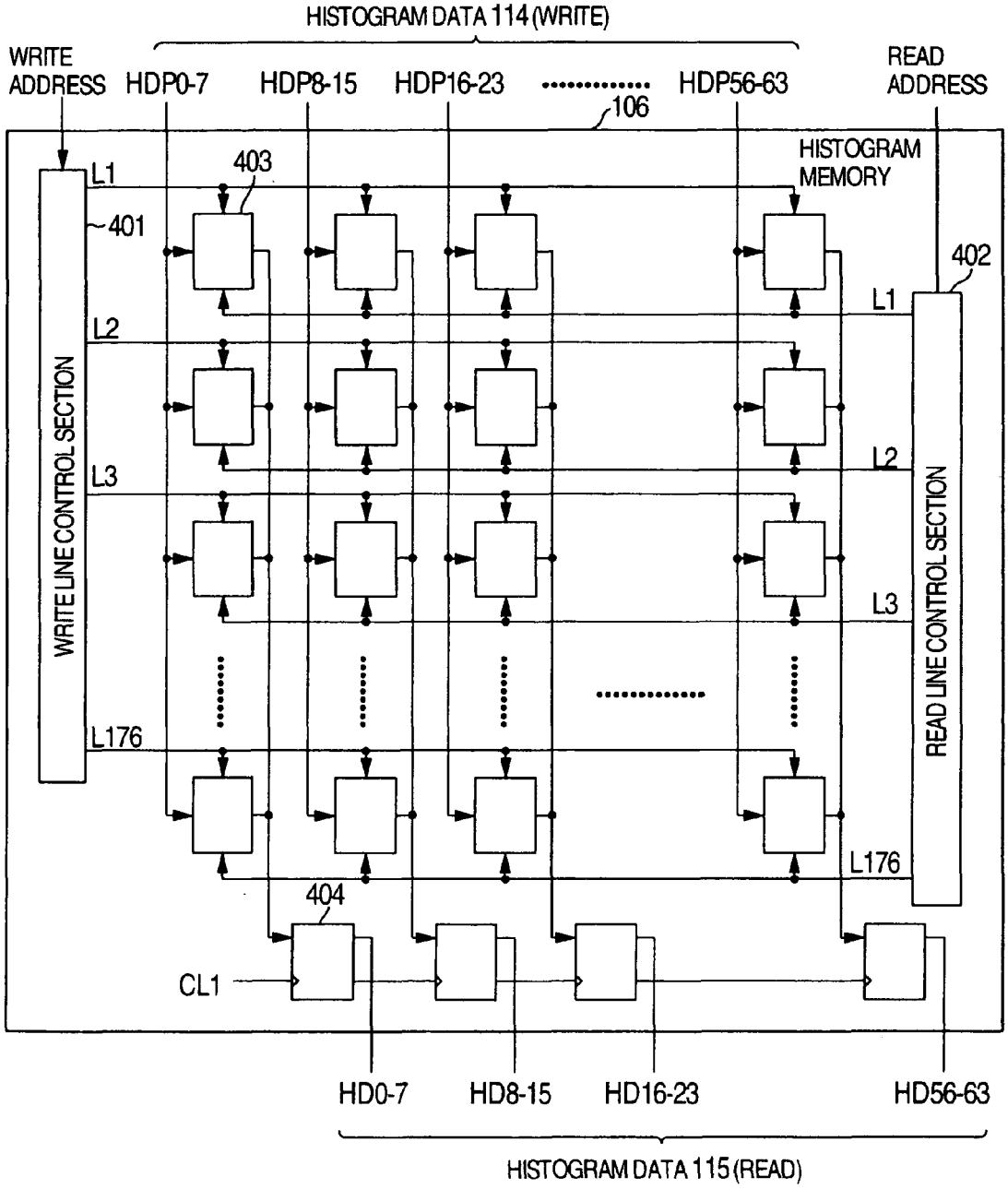
FIG. 4 is a diagram showing a configuration of a histogram memory according to a first embodiment of the present invention.

A configuration and operation of the histogram memory 106 will now be described by referring to FIG. 4. In FIG. 4, numeral 401 denotes a write line control section, 402 a read line control section, 403 a memory cell, and 404 a latch. The capacity of the memory cells is 8 groups×4 bits×176 lines. First, the write line control section 401 receives a write address transferred from the timing control section, and outputs "H" to a line that coincides with address data. For example, if the address data is 3h, then the write line control section outputs "H" to an L3 line shown in FIG. 4 and outputs "L" to other lines. In the same way, the read line control section 402 receives a read address transferred from the timing control section, and outputs "H" to a line that coincides with address data. For example, if the address data is 1h, then the read line control section outputs "H" to an L1 line shown in FIG. 4 and outputs "L" to other lines. The write address corresponds to a scanning line from which the histogram data has been detected. The read address corresponds to an address at the time when the display data 112 is read out from the display memory 104. The memory cell 403 has terminals of write enable WE, read enable RE, data input D, and data output Q. When the write enable WE is "H", data is taken in from the data input terminal D and stored. When the read enable RE is "H", stored data is output from the data output terminal Q. The latches 404 latch the histogram data output from the memory cells 403 in synchronism with CL1, and output it as the histogram data 115. Owing to the operation heretofore described, the histogram memory 106 can store the detected histogram data 114 of each scanning line, and output the histogram data 115 of display data read out from the display memory 104 at the same timing. The histogram memory 106 may store the histogram data 114 of all lines, or may store the histogram data 114 corresponding to a plurality of lines less than all lines.

Figure 5:
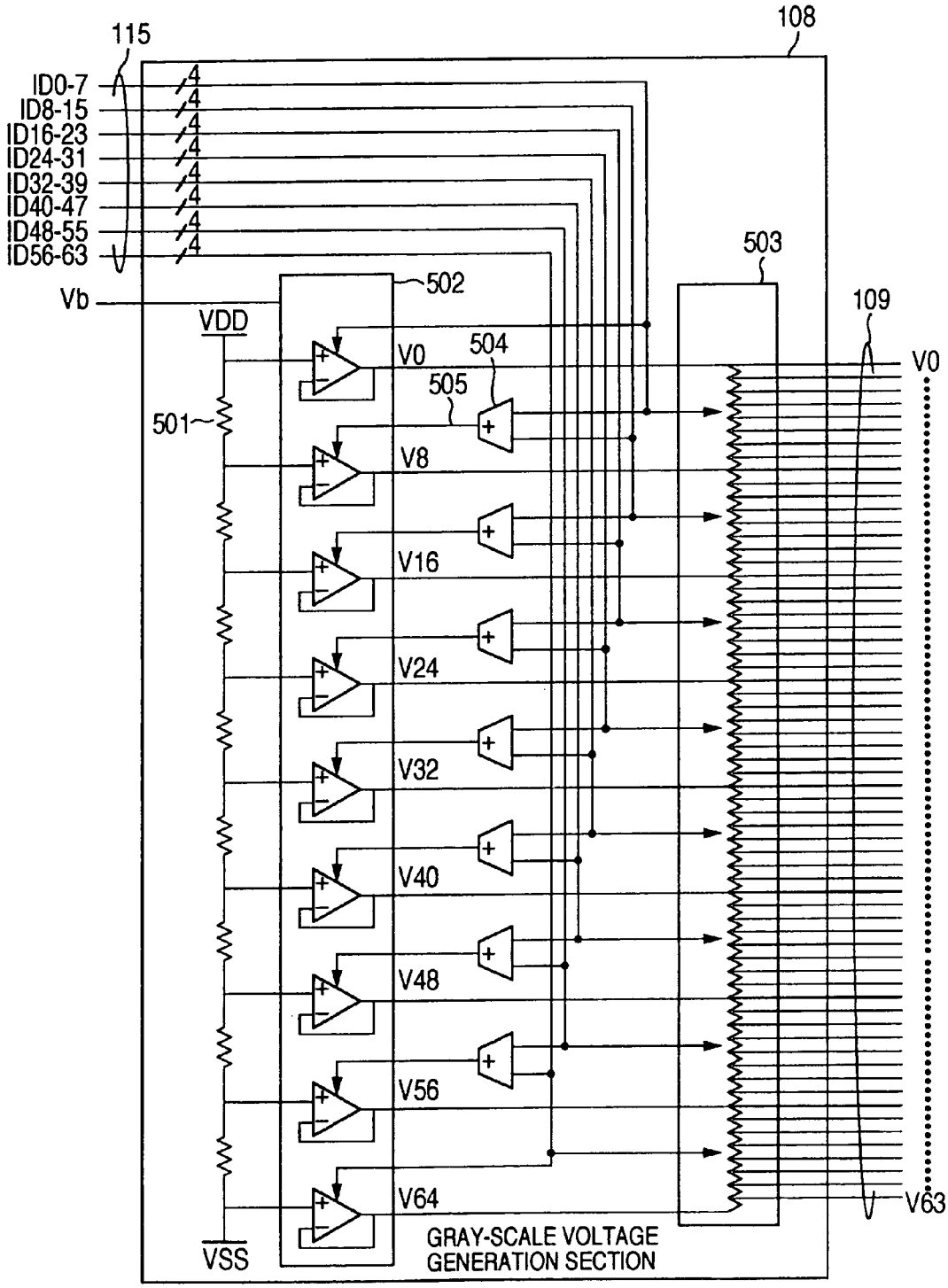
FIG. 5 is a diagram showing a configuration of a gray-scale voltage generation section according to a first embodiment of the present invention.

A configuration of the gray-scale voltage generation section 108 will now be described by referring to FIG. 5. In FIG. 5, numeral 501 denotes a string resistor section for reference voltage generation, 502 buffer circuits, 503 a string resistor section for gray-scale voltage generation, 504 an adder, and 505 histogram data. The string resistor section 501 conducts voltage division between a high potential power supply voltage VDD and a low potential power supply voltage VSS, and generates reference voltages of a plurality of levels (for example, nine levels of V0, V8, V16, V24, V32, V40, V48, V56 and V64). The buffer circuit 502 converts the reference voltages to low impedance reference voltages and outputs the low impedance reference voltages. The string resistor section 503 generates gray-scale voltages of intermediate levels from reference voltages of adjacent levels. For example, the string resistor section 503 divides each of voltage differences between adjacent reference voltages into eight parts and thereby generates gray-scale voltages V0-V63 of 64 levels.

By taking one of the buffer circuits 502 as an example, operation thereof will now be described. Besides the reference voltages, a bias voltage Vb and histogram data 505 are input to the buffer circuits 502. Each of the histogram data 505 corresponds to a voltage range influenced by a buffer circuit. For example, a buffer circuit of V0 influences gray-scale voltages V0 to V7. Therefore, histogram data of HD0-7 are input to the buffer circuit of V0. A buffer circuit of V8 influences gray-scale voltages V1 to V15. Therefore, histogram data of HD0-7 and HD8-15 are added by an adder 504. Four high-order bits of the result are input as histogram data 505.

Figure 6:
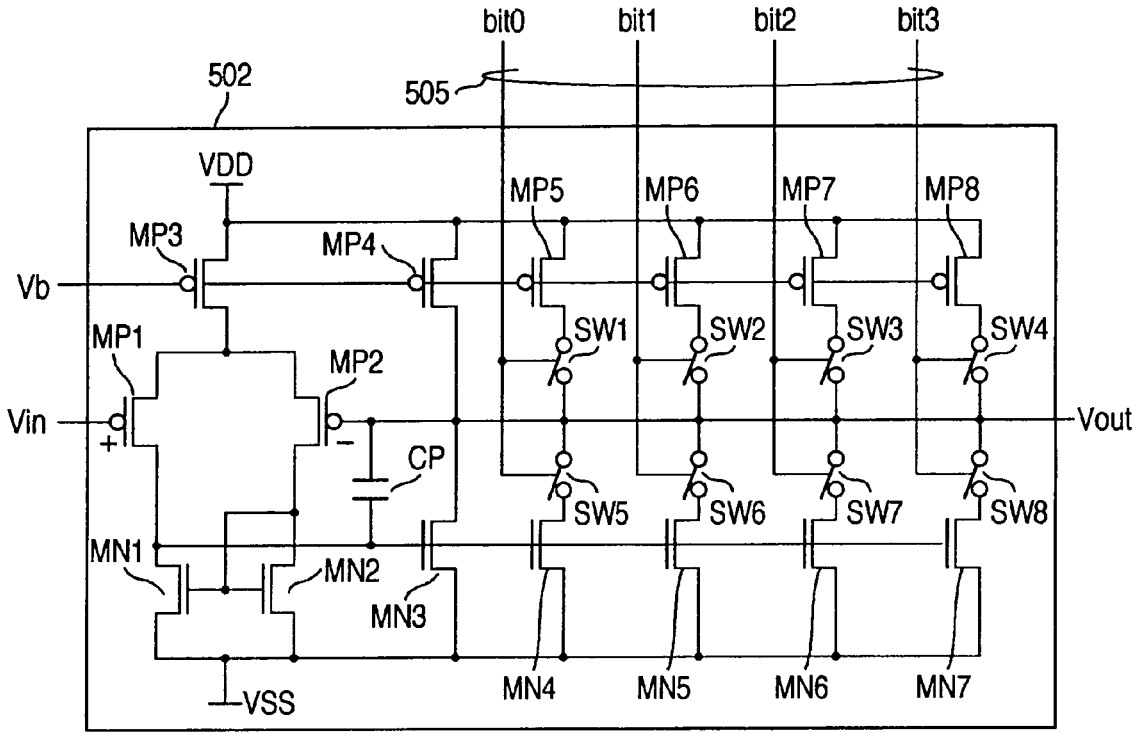
FIG. 6 is a diagram showing a configuration of a buffer circuit according to a first embodiment of the present invention.

A configuration of the buffer circuit 502 will now be described by referring to FIG. 6. In FIG. 6, MP1 to MP8 denote PMOS transistors, and MN1 to MN8 denote NMOS transistors. SW1 to SW8 denote switches, and CP a capacitor for phase compensation. First, sources of PMOS transistors MP1 and MP2 are connected together. Furthermore, drains of the PMOS transistor MP1 and an NMOS transistor MN1 are connected together, and drains of the PMOS transistor MP2 and an NMOS transistor MN2 are connected together. Sources of the NMOS transistors MN1 and MN2 are connected to the low potential power supply voltage VSS. The drain of the NMOS transistor MN2 is connected to gates of the NMOS transistors MN1 and MN2 to function as a dynamic load. The PMOS transistor MP3 is connected at its source to the high potential power supply voltage VDD, and connected at its drain to the sources of the PMOS transistors MP1 and MP2. The PMOS transistor MP3 is connected at its gate to the bias voltage Vb, and the PMOS transistor MP3 functions as a constant current source. In other words, a circuit including the PMOS transistors MP1 to MP3 and NMOS transistors MN1 and MN2 is a differential amplification stage having the gate of the PMOS transistors MP1 as a non-inverting input and the gate of the PMOS transistors MP2 as an inverting input. An output of this differential amplification stage is obtained at the drain of the PMOS transistor MP1, which is connected to the NMOS transistor MN3 at its gate. The NMOS transistor MN3 is connected at its source to the low potential power supply voltage VSS. Drains of the NMOS transistor MN3 and the PMOS transistor MP4 are connected together. The PMOS transistor MP4 is connected at its source to the high potential power supply voltage VDD, and connected at its gate to the bias voltage Vb. The PMOS transistor MP4 functions as a constant current source, and a first output amplification stage is thus constituted. The NMOS transistor MN3 of the output amplification stage is connected at its drain to an output Vout and the inverting input of the differential amplification stage. A capacitor CP for phase compensation is connected between the gate of the NMOS transistor MN3 and the output Vout, and an operational amplifier of the so-called voltage follower type is thus constituted. Therefore, the output voltage Vout becomes equal in potential to the input voltage Vin. In addition, the PMOS transistors MP5 to MP8 are connected at their sources to the high potential power supply voltage VDD, connected at their gates to the bias voltage Vb, and connected at their drains to the output Vout via switches SW1 to SW4, respectively. Furthermore, the NMOS transistors MN4 to MN7 are connected at their sources to the low potential power supply voltage VSS, connected at their gates to the drain of the PMOS transistor MP1 serving as the output of the differential amplifier, and connected at their drains to the output Vout via switches SW5 to SW8, respectively. The switches SW1 to SW8 are controlled by histogram data 505. If a corresponding bit of the histogram data 505 is a high level, then the switch turns on and a current can be flown. In the same way as the first output amplification stage including the PMOS transistor MP4 and the NMOS transistor MN3, the PMOS transistor MP5 and the NMOS transistor MN4 constitute a second output amplification stage, the PMOS transistor MP6 and the NMOS transistor MN5 a third output amplification stage, the PMOS transistor MP7 and the NMOS transistor MN6 a fourth output amplification stage, and the PMOS transistor MP8 and the NMOS transistor MN7 a fifth output amplification stage. The bias currents are controlled by the switches. The bias current quantity supplied by the output amplification stage will now be described. First, if the histogram data 505 is "0h", then all of the switches SW1 to SW8 of the second to fifth output amplification stages are in the off-state, and a bias current is not supplied from these output amplification stages. If the histogram data 505 is "1h", then the switches SW1 and SW5 of the second output amplification stage are in the on-state, and a bias current is supplied from these output amplification stages. Each of the output amplification stages operates so as to flow a bias current proportionate to the corresponding bit weight of the histogram data 505. As a result, the bias current of the buffer circuit 502 is nearly proportionate to the histogram data 505. A minimum bias current becomes approximately 1/16 of a maximum bias current. In the case of MOS transistors, the bias current is proportionate to the transistor size. It is necessary that transistor sizes of the PMOS transistors MP5 to MP8 have a ratio of 1:2:4:8. In the same way, it is necessary that transistor sizes of the NMOS transistors MN4 to MN7 have a ratio of 1:2:4:8. Bias current values can be determined easily.

Figure 7:
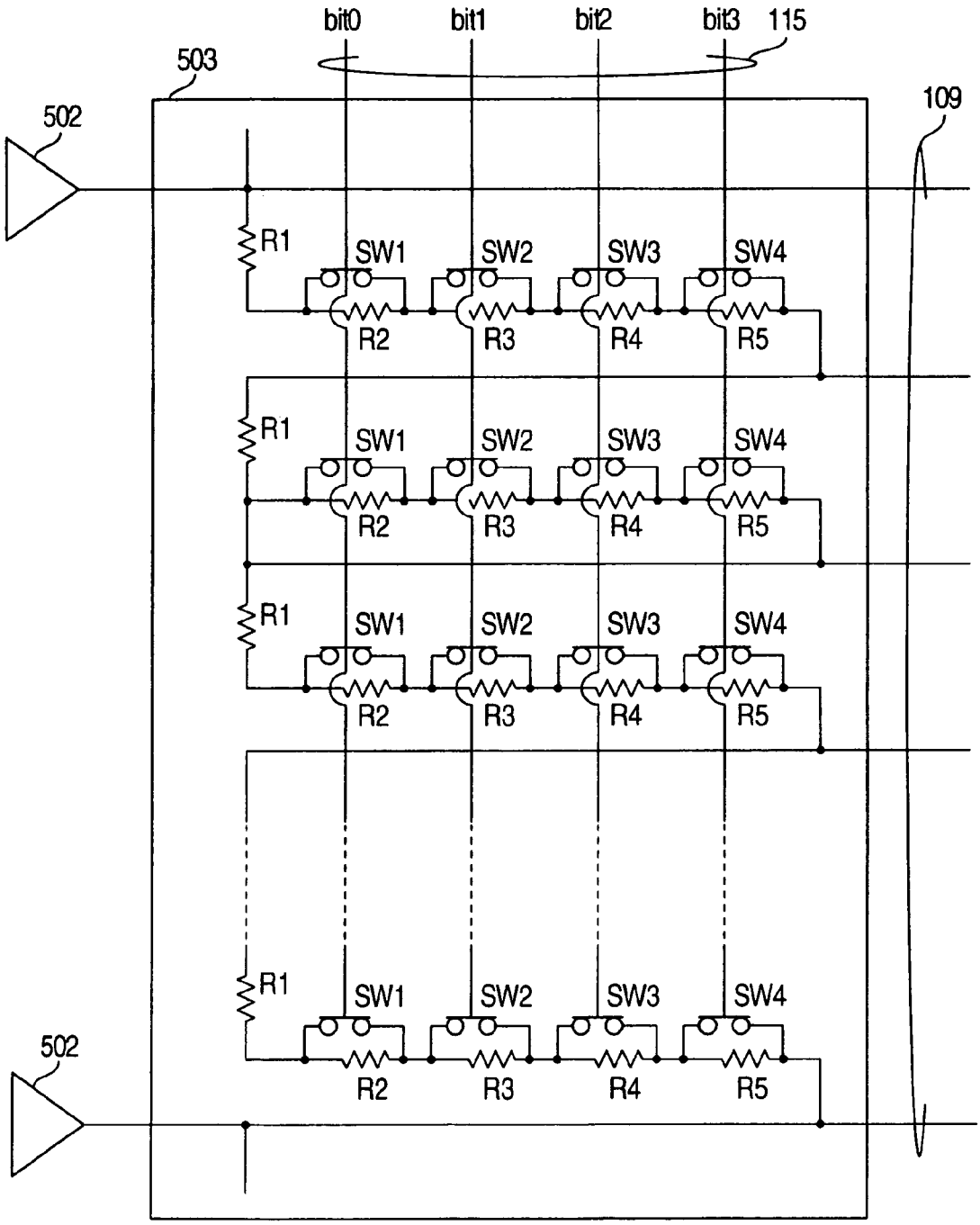
FIG. 7 is a diagram showing a configuration of a string resistor section according to a first embodiment of the present invention.

A configuration of the string resistor section 503 will now be described by referring to FIG. 7. FIG. 7 shows a configuration of a section for generating gray-scale voltages between two reference voltages. R1 to R5 denote resistors, and SW1 to SW4 denote switches. The switches SW1 to SW4 are controlled by bit 0 to bit 3 of the histogram data 115, respectively. For example, if the histogram data 115 is "0h", then all of the switches SW1 to SW4 are in the off-state, and a composite resistance value between adjacent gray-scale voltages becomes R1+R2+R3+R4+R5. In the same way, if the histogram data 115 is "1h", then the switches SW1 is in the on-state, and a composite resistance value between adjacent gray-scale voltages becomes R1+R3+R4+R5. By setting the resistance ratios of R2 to R5 equal to 1:2:4:8, resistance values between adjacent gray-scale voltages become values that are nearly in inverse proportion to the histogram data 115. Therefore, a required minimum driving current can be flown according to the input display data, which is the object of the present invention. As a result, a higher efficiency can be attained.

Figure 8A:
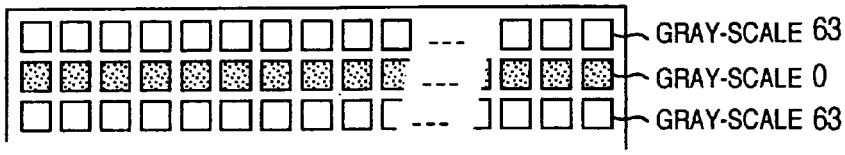
FIGS. 8A-8C are diagrams showing a power consumption reduction effect of a liquid crystal driving circuit according to a first embodiment of the present invention.
Figure 8B:
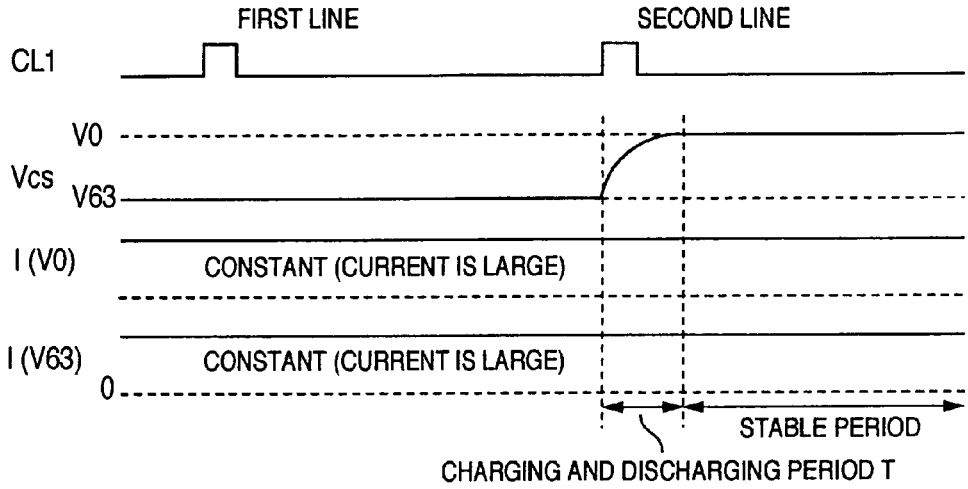
Figure 8C:
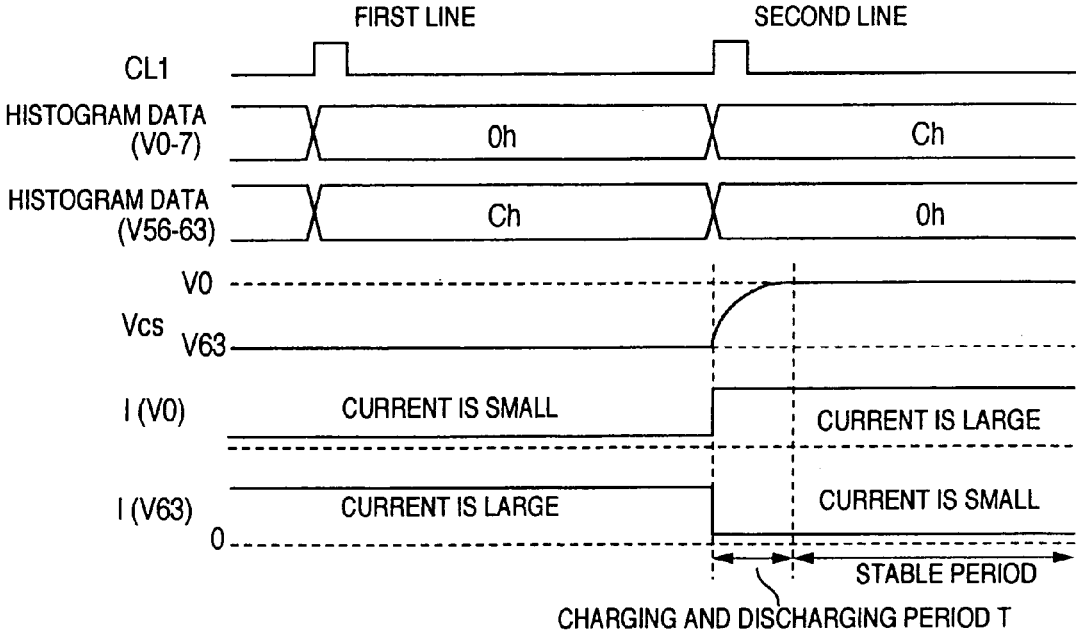

An effect of the liquid crystal driving circuit according to the present invention will now be described by referring to FIGS. 8A-8C. FIG. 8A shows a display image of the liquid crystal panel 121. In order to simplify the ensuing description, it is assumed that there are 384 pixels in the horizontal direction and 176 lines in the vertical direction. It is also assumed that the gray-scale 63 is displayed on all pixels on the first line and the third line and subsequent lines and the gray-scale 0 is displayed on all pixels on the second line. Furthermore, it is assumed that the voltage corresponding to the gray-scale 0 is V0 and the voltage corresponding to the gray-scale 63 is V63. FIG. 8B shows operation of the liquid crystal driving circuit of the conventional type. Vcs denotes a potential difference across a data line load CS. First, Vcs of the first line is V63. On the second line, Vcs is charged from V63 to V0. At this time, steady-state currents of the buffer circuits for generating respective gray-scale voltages and string resistors are constant (maximum values). FIG. 8C shows operation of the liquid crystal driving circuit to which the histogram detection section, which is a principal feature of the present invention, and the gray-scale voltage generation section having adjustable steady-state currents have been applied. In the same way as FIG. 8B, Vcs on the second line is charged from V63 to V0. At this time, steady-state currents of the buffer circuit for generating V0 and string resistors assume maximum values, whereas steady-state currents of other portions assume minimum values.

As heretofore described, current quantities supplied in accordance with the histogram of the display data are adjusted and display is conducted. Therefore, power consumption can be reduced remarkably.

Second Embodiment

Figure 10:
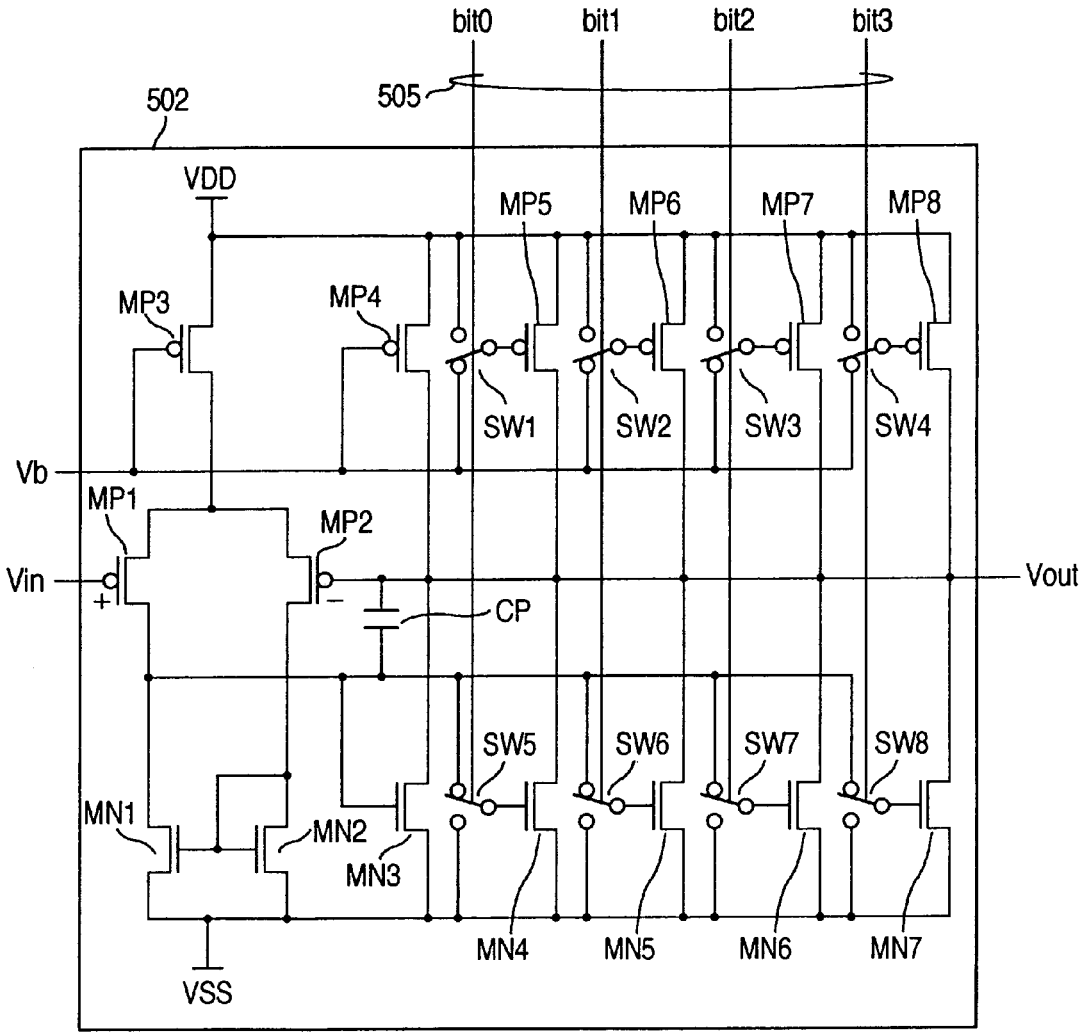
FIG. 10 is a diagram showing a configuration of a buffer circuit according to a second embodiment of the present invention.

Hereafter, a buffer circuit according to a second embodiment of the present invention will be described by referring to FIG. 10. The present embodiment has a feature that the circuit scale has been reduced. The second embodiment differs from the first embodiment in internal configuration of the buffer circuit 502. As shown in FIG. 10, an operational amplifier of voltage follower type including PMOS transistors MP1 to MP4, NMOS transistors MN1 to MN3, and a phase compensation capacitor CP has a configuration similar to that shown in FIG. 6. In addition, sources of PMOS transistors MP1 to MP4 are connected to the high potential power supply voltage VDD. Gates of the PMOS transistors MP1 to MP4 are connected to either the bias voltage Vb or the high potential power supply voltage VDD via switches SW1 to SW4, respectively. Drains of the PMOS transistors MP1 to MP4 are connected to an output Vout. Furthermore, sources of NMOS transistors MN4 to MN7 are connected to the low potential power supply voltage VSS. Gates of the NMOS transistors MN4 to MN7 are connected to either the drain of the PMOS transistor MP1 serving as the output of the differential amplification stage or the low potential power supply voltage VSS via switches SW5 to SW8, respectively. Drains of the NMOS transistors MN4 to MN7 are connected to the output Vout. The switches SW1 to SW8 are controlled by the histogram data 505. If a corresponding bit of the histogram data 505 is a high level, then the gate of the PMOS transistor is connected to the bias voltage Vb via one switch, and the gate of the NMOS transistor is connected to the drain of the PMOS transistor MP1 via the other switch, and it becomes possible to flow a current. If a corresponding bit of the histogram data 505 is a low level, then the gate of the PMOS transistor is connected to the high potential power supply voltage VDD via one switch, and the gate of the NMOS transistor is connected to the low potential power supply voltage VSS via the other switch, and it becomes possible to flow a current. In the same way as the first output amplification stage including the PMOS transistor MP4 and the NMOS transistor MN3, the PMOS transistor MP5 and the NMOS transistor MN4 constitute a second output amplification stage, the PMOS transistor MP6 and the NMOS transistor MN5 a third output amplification stage, the PMOS transistor MP7 and the NMOS transistor MN6 a fourth output amplification stage, and the PMOS transistor MP8 and the NMOS transistor MN7 a fifth output amplification stage. The output current is controlled by the switches.

In the configuration of the output stage of the buffer circuit 502 according to the first embodiment, a switch is provided between a PMOS transistor and the output Vout and another switch is provided between an NMOS transistor and the output Vout. As switches, MOS switches are typically used. For outputting a predetermined current, it is necessary to lower the switch impedance, i.e., increase the MOS size. Thus, the circuit scale is relatively large. On the other hand, in the configuration of the output stage of the buffer circuit 502 according to the present embodiment, the PMOS transistor and the NMOS transistor are directly coupled to the output Vout, and the impedance of the switch and the impedance of the output amplification stage have no direct relation to with each other. The switches are provided for gates of the PMOS transistor and the NMOS transistor. Even if the MOS size is decreased, therefore, there is no problem.

Since the switch size can be made small as heretofore described, it becomes possible to reduce the circuit scale.

Third Embodiment

Hereafter, a buffer circuit according to a third embodiment of the present invention will be described by referring to FIG. 11. The present embodiment has a feature that the circuit scale has been reduced. The present embodiment is different from the first and second embodiments in internal configuration of the buffer circuit 502.

Figure 11:
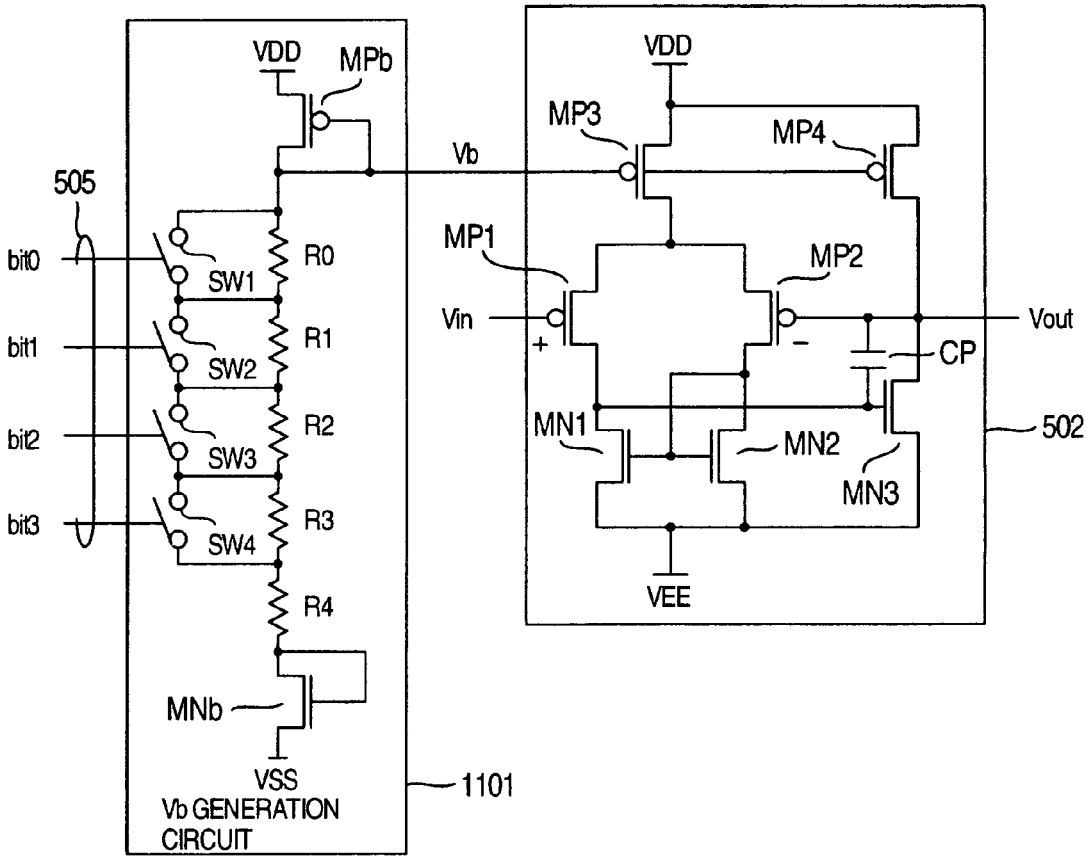
FIG. 11 is a diagram showing a configuration of a buffer circuit according to a third embodiment of the present invention.

As shown in FIG. 11, an operational amplifier of voltage follower type including PMOS transistors MP1 to MP4, NMOS transistors MN1 to MN3, and a phase compensation capacitor CP has a configuration similar to that shown in FIG. 6. The buffer circuit 502 according to the first embodiment shown in FIG. 6 includes a plurality of output amplification stages. However, a buffer circuit 502 according to the present embodiment shown in FIG. 11 need only to have a single output amplification stage. Furthermore, although the circuit for generating the bias voltage Vb in the buffer circuit 502 according to the first embodiment has not been described especially in detail, the generation circuit generates a certain constant voltage so that the PMOS transistors MP3 to MP8 may operate as constant current circuits. Furthermore, the same bias voltage Vb is supplied to a plurality of buffer circuits 502. Furthermore, the buffer circuit 502 switches over the output amplification stage and thereby changes the output current. The buffer circuit 502 according to the present embodiment has a feature that the output currents of the PMOS transistors MP3 to MP4 are changed by switching over the potential of the bias voltage Vb. Furthermore, respective buffer circuits 502 have corresponding Vb generation circuits 1101, and supply respectively different bias voltages Vb.

A concrete configuration of the Vb generation circuit 1101 will now be described. In FIG. 11, MPb denotes an PMOS transistor, MNb an NMOS transistor, R0 to R4 resistors, and SW1 to SW4 switches. The PMOS transistor MPb is connected at its source to the high potential power supply voltage VDD and its gate is connected to its drain. The NMOS transistor MNb is connected at its source to the low potential power supply voltage VSS and its gate is connected to its drain. The drain of the PMOS transistor MPb is connected to the drain of the NMOS transistor MNb via resistors R0 to R4 connected in series. The resistors R0 to R4 are connected in parallel with the switches SW1 to SW4, respectively. The switches SW1 to SW4 are controlled by the histogram data 505. The Vb generation circuits 1101 are provided for the buffer circuits 502 in one-to-one correspondence.

Operation of the Vb generation circuit 1101 will now be described. A composite resistance of the resistors R0 to R4 connected in series is controlled by the histogram data 505. When the histogram data 505 is "0h", all of the switches SW1 to SW4 turn off and the composite resistance becomes R4+R3+R2+R1+R0. When the histogram data 505 is "Fh", all of the switches SW1 to SW4 turn on and the composite resistance becomes R4. In other words, the resistance value changes with the data weights of the histogram data 505. When the value of the histogram data 505 is low, the bias voltage Vb becomes high and the bias current value of the buffer circuit 502 becomes small. When the value of the histogram data 505 is high, the bias voltage Vb becomes low and the bias current value of the buffer circuit 502 becomes large.

As heretofore described, the number of the MOS transistors and switches can be reduced. As a result, the circuit scale can be reduced.

Fourth Embodiment

Hereafter, a liquid crystal driving circuit according to another embodiment of the present invention will be described by referring to FIGS. 12 and 13. The present embodiment has a feature that histogram detection is conducted without reading out the display data serially from the display memory. In order to implement this, currents flowing through gray-scale voltages are detected, an interval for converting this to digital histogram data is provided in one horizontal scanning interval, and the steady-state currents of the gray-scale voltage generation section are controlled in the remaining interval of the one horizontal scanning interval.

First, a configuration of a liquid crystal driving circuit according to the present embodiment will now be described.

Figure 12:
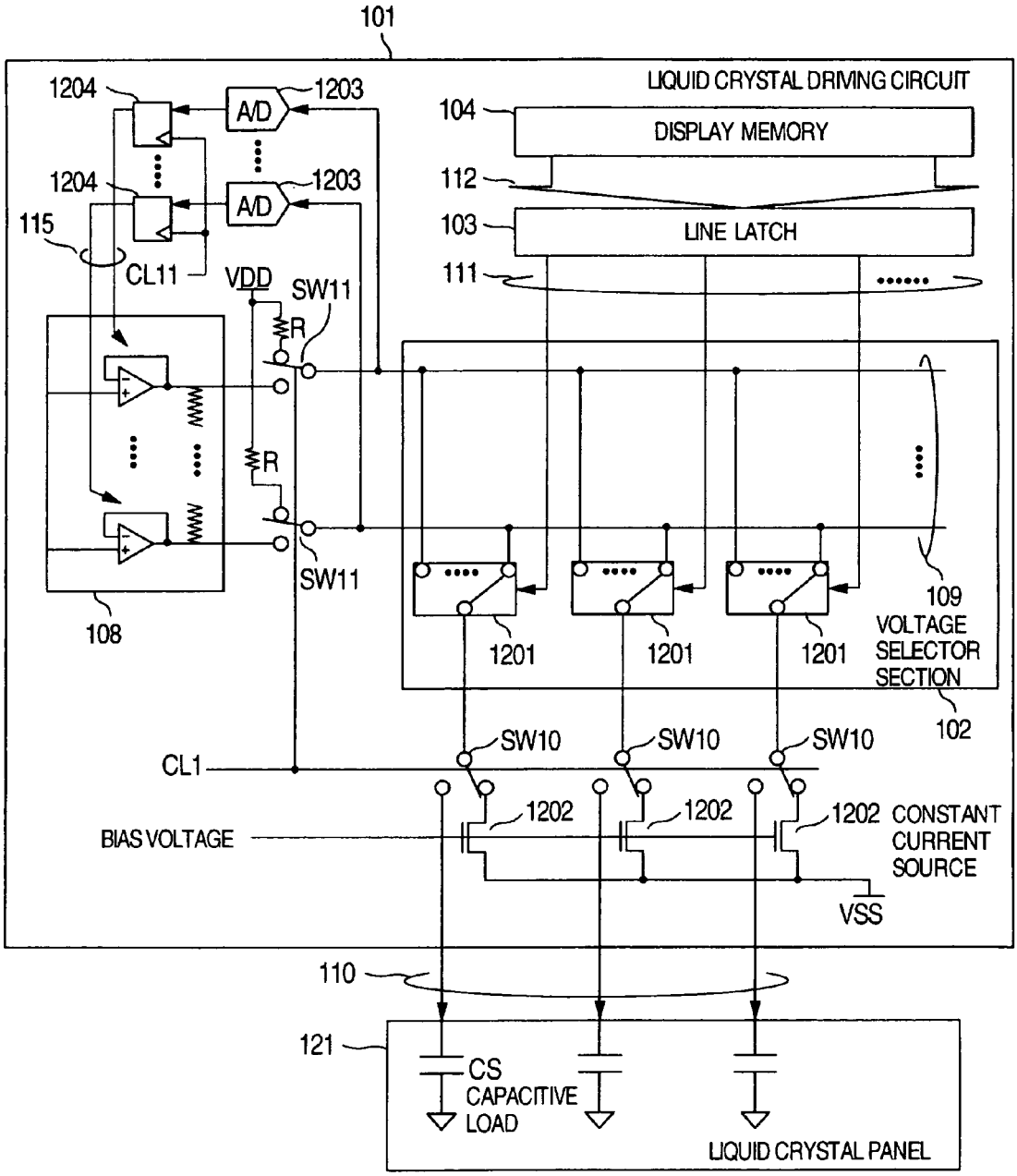
FIG. 12 is a diagram showing a schematic configuration of a liquid crystal driving circuit according to a second embodiment of the present invention.
Figure 13:
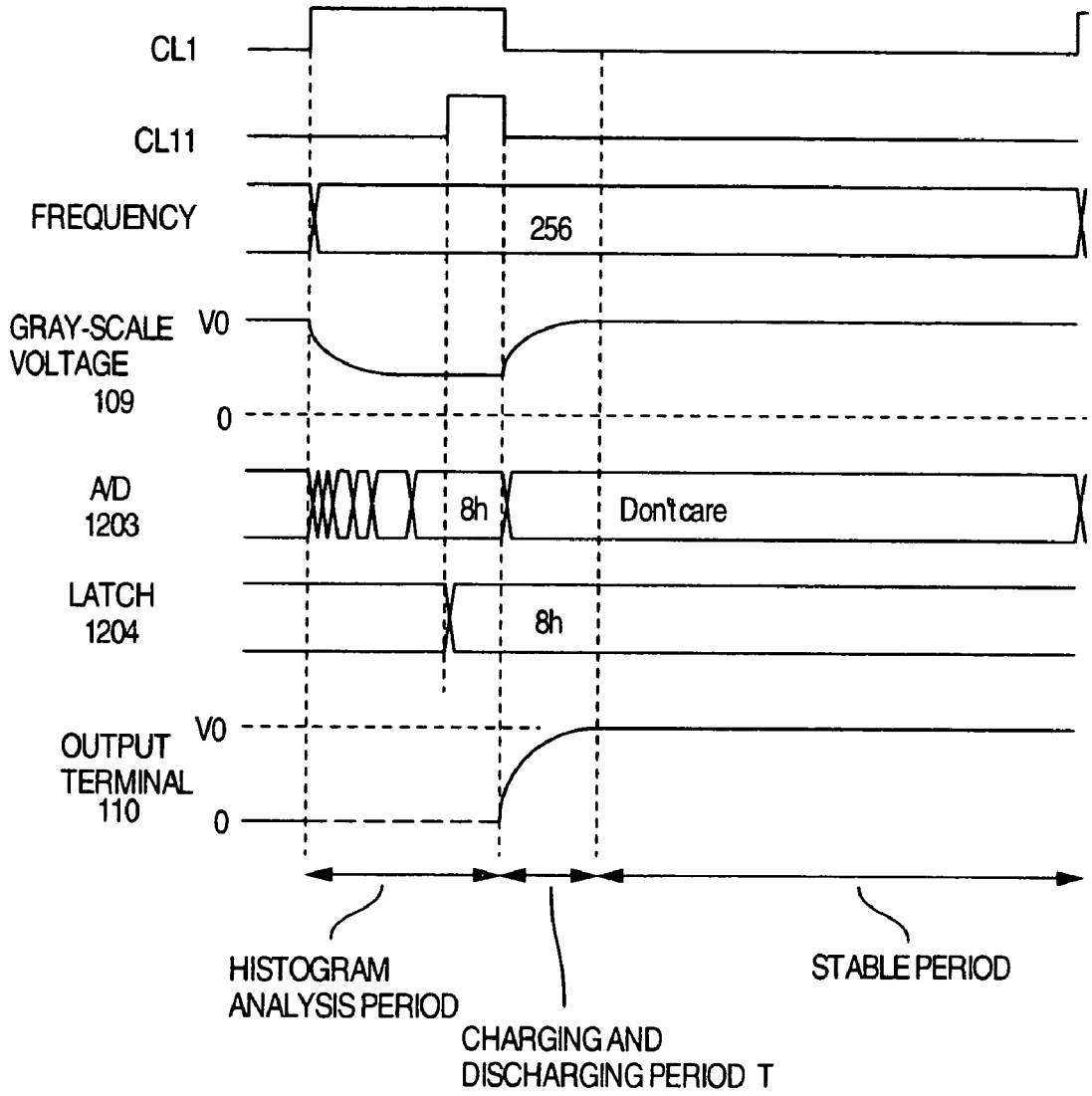
FIG. 13 is a diagram showing a configuration of a histogram detection section according to a second embodiment of the present invention.

In FIG. 12, numeral 1201 denotes a selection circuit, 1202 a constant current source, 1203 an A/D converter, 1204 a latch, SW10 and SW11 switches, R a resistor, and CL11 a latch clock. The same elements as those of the first embodiment of the present invention are denoted by like characters, and conduct the same operation. The SW10 is a switch for connecting the output of the voltage selector section 102 to either the constant current source 1202 or the output terminal group 110. The SW11 is a switch for connecting either an output of the gray-scale voltage generation section 108 or the high potential power supply voltage VDD supplied via the resistor R to the gray-scale voltage group 109. The A/D converter 1203 is means for converting a voltage value of the gray-scale voltage group 109 to digital data. The latch 1204 is means for latching a digital output of the A/D converter 1203.

Operation of the liquid crystal driving circuit 101 according to the present embodiment will now be described by referring to FIGS. 12 and 13. In the same way as the liquid crystal driving circuit 101 according to the first embodiment, the display data output from the display memory 104 is temporarily stored in the line latch 103, and the latch data 111 is output. According to the latch data 111, a predetermined gray-scale voltage is selected in the voltage selector section 102 and output. At this time, a high level interval of the clock CL1 is used as a histogram detection section, and the switch SW10 connects the constant current source 1202 to the output of the voltage selector section 102. In addition, the switch SW11 connects the high potential power supply voltage VDD via the resistor R to the gray-scale voltage group 109. Therefore, as many constant current sources 1202 as the number of lines of the gray-scale voltage selected by the latch data 111 are connected to the gray-scale voltage group 109. Each voltage of the gray-scale voltage group 109 transits to a potential proportionate to the selected number of lines. For example, when the frequency of the gray-scale voltage V0 is 256 as shown in FIG. 13, the gray-scale voltage of the gray-scale voltage group 109 has a potential determined by 256 constant current sources connected in parallel and the resistor R. And the potential of the gray-scale voltage group 109 is converted to digital data by the A/D converter. When the potential of the gray-scale voltage group has become sufficiently stable, it is taken in the latch 1204 by the clock 11. The latched digital data is output to the gray-scale voltage generation section 108 as the histogram data 115. Immediately after taking in the latch 1204 has been finished, the CL1 becomes a low level. The outputs of the voltage selector section 102 are thus connected to the output terminal group 110, and the outputs of the gray-scale voltage generation section 108 are connected to the gray-scale voltage group 109. A gray-scale voltage suitably current-amplified is output to the output terminal group 110.

In the liquid crystal driving circuit according to the present embodiment, it is not necessary to read out display data serially from the display memory. Therefore, power consumption required for this operation can be reduced.

Fifth Embodiment

Figure 14:
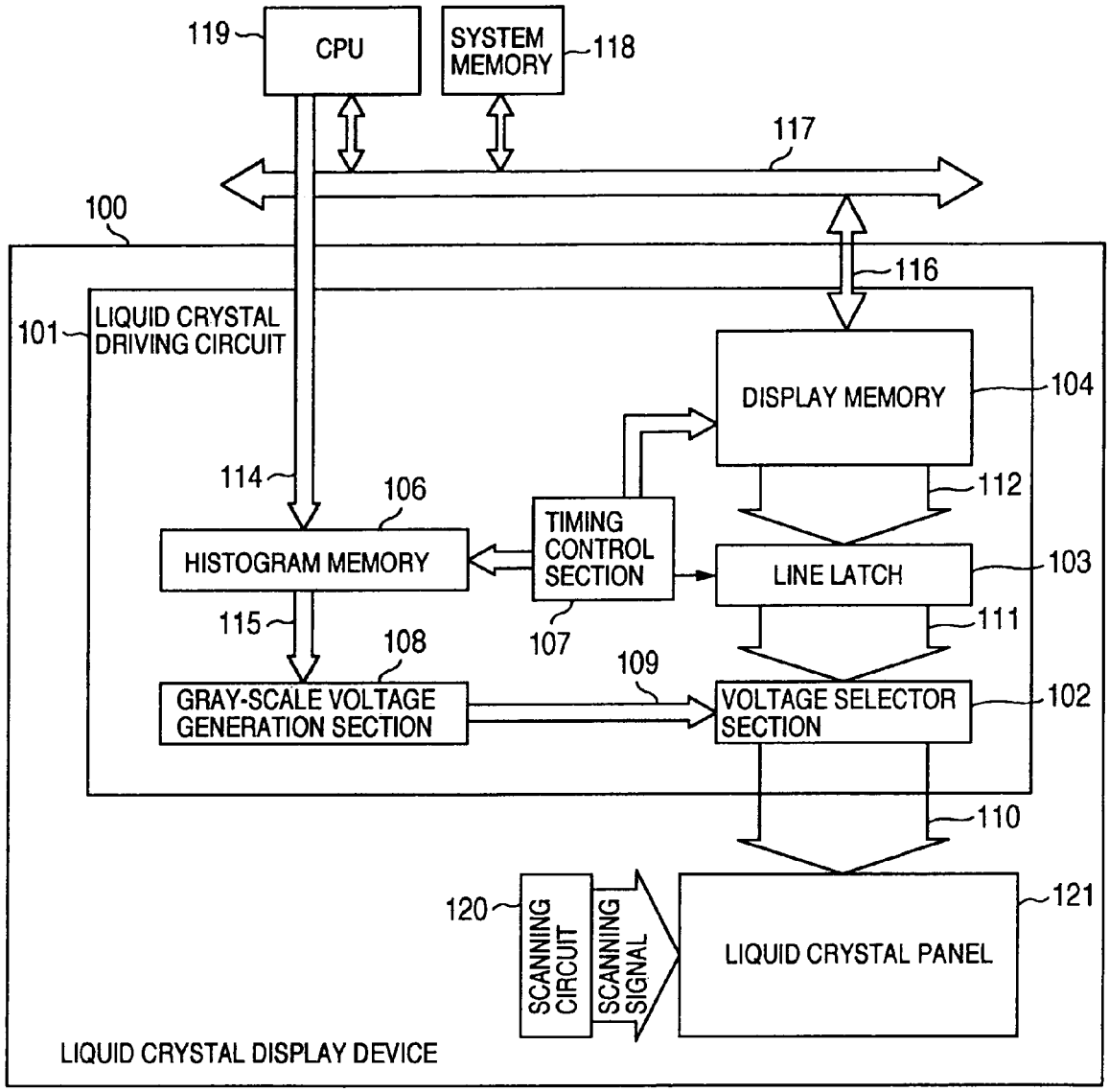
FIG. 14 is a diagram showing a schematic configuration of a liquid crystal driving circuit according to a third embodiment of the present invention.
Figure 15:
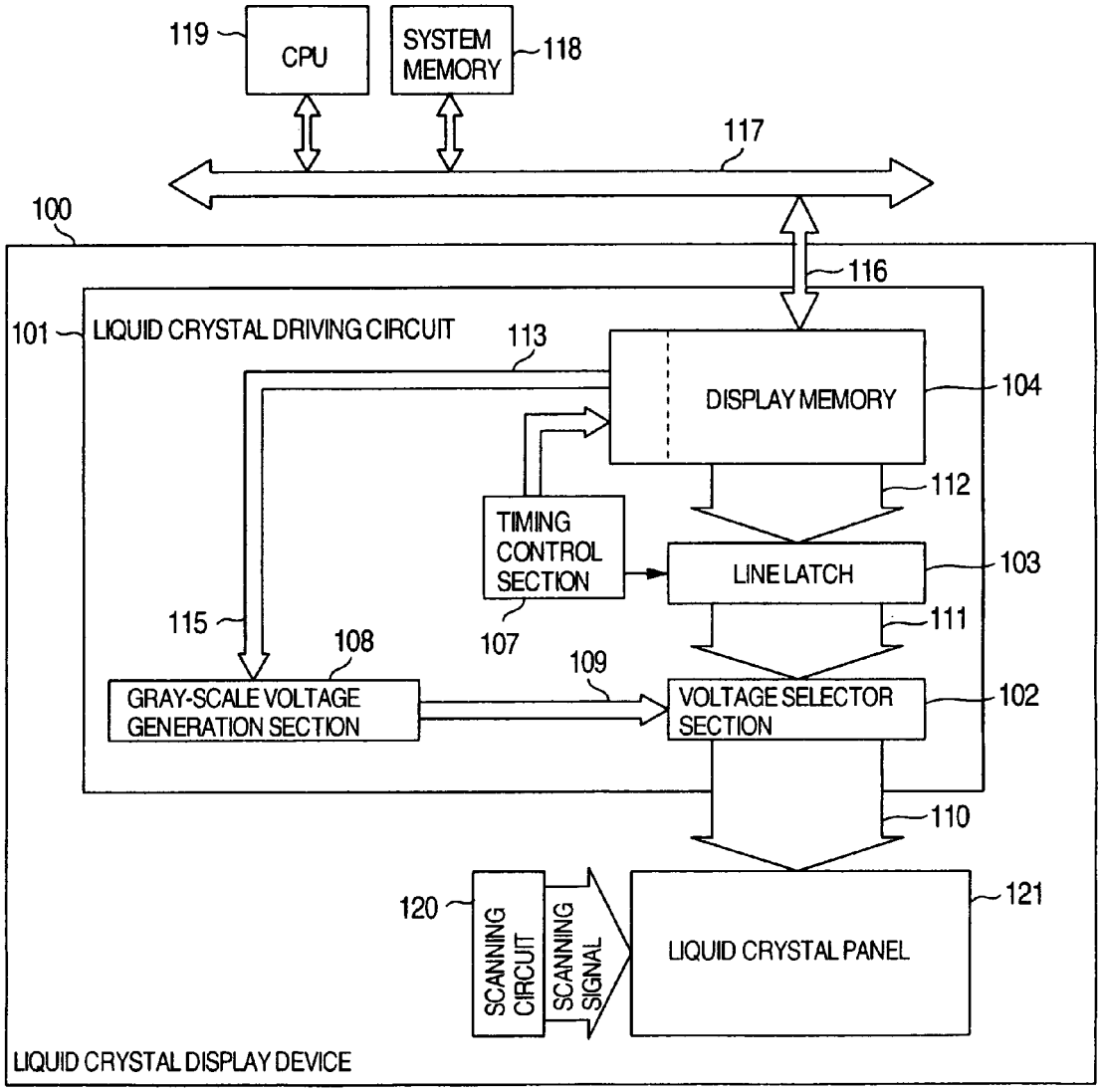
FIG. 15 is a diagram showing a schematic configuration of a liquid crystal driving circuit according to a fourth embodiment of the present invention.
Figure 16:
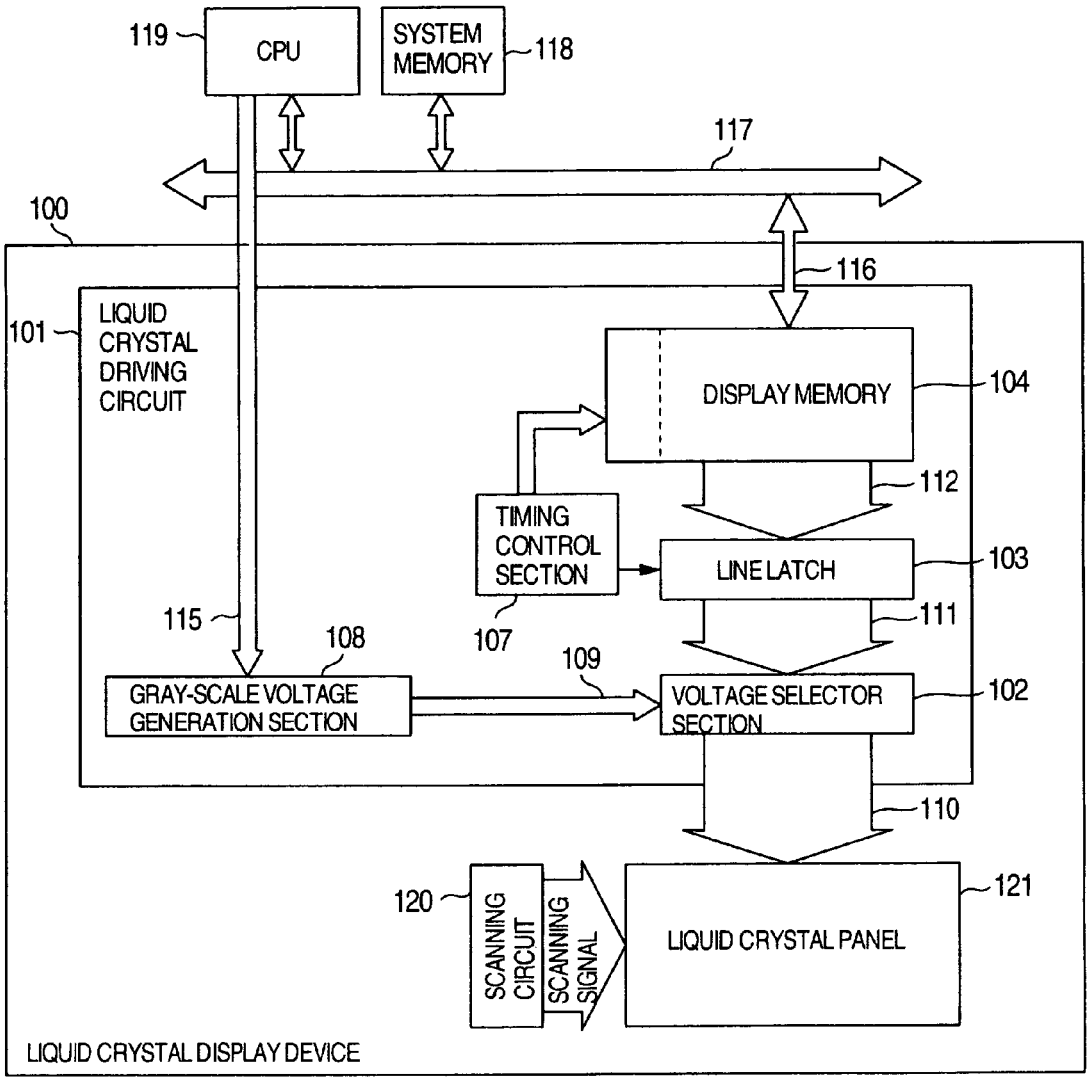
FIG. 16 is a diagram showing a schematic configuration of a liquid crystal driving circuit according to a fifth embodiment of the present invention.

Hereafter, a liquid crystal driving circuit according to yet another embodiment of the present invention will be described by referring to FIGS. 14 to 16. The present embodiment has a feature that histogram detection is conducted in the external CPU instead of the liquid crystal driving circuit. The device that writes display data into the display memory 104 is the CPU 119, and it a matter of course that the CPU 119 can know the content that has been written. For example, if the display data written into the display memory is stored in the system memory 118, it is easy to know the content. Therefore, the CPU 119 can detect the histogram from the display data. Accordingly, the fifth embodiment of the present invention can be implemented if the CPU 119 conducts operation of storing histogram data of all lines in the histogram memory 106. The histogram memory 106 may have a configuration similar to that of the first embodiment of the present invention. All control signals required for the memory function may be transferred from the CPU 119. As shown in FIG. 15, there may be adopted such a configuration that the histogram memory 106 is abolished and the histogram data is stored in a part of the display memory. Furthermore, as shown in FIG. 16, there may be adopted such a configuration that the histogram memory 106 is abolished and the CPU 119 outputs the histogram data of each line directly to the gray-scale voltage generation section 108. In order to synchronize the display data to the histogram data, it is necessary that the CPU 119 outputs the histogram data in synchronism with a horizontal synchronizing signal and a vertical synchronizing signal generated by the liquid crystal driving circuit. Or it is necessary that the CPU 119 generates a horizontal synchronizing signal and a vertical synchronizing signal and outputs the histogram data and the liquid crystal driving circuit operates in synchronism with the horizontal synchronizing signal and vertical synchronizing signal.

In the liquid crystal driving circuit according to the present embodiment, it is not necessary to conduct histogram detection and store the histogram data within the liquid crystal driving circuit. As a result, the circuit scale can be reduced.

Sixth Embodiment

Hereafter, a histogram detection section of a liquid crystal driving circuit according to a sixth embodiment of the present invention will be described by referring to FIGS. 17 to 20. The present embodiment has a feature that the histogram data is converted according to the load of the liquid crystal panel 121. The histogram detection section in the first embodiment is expanded.

Figure 17:
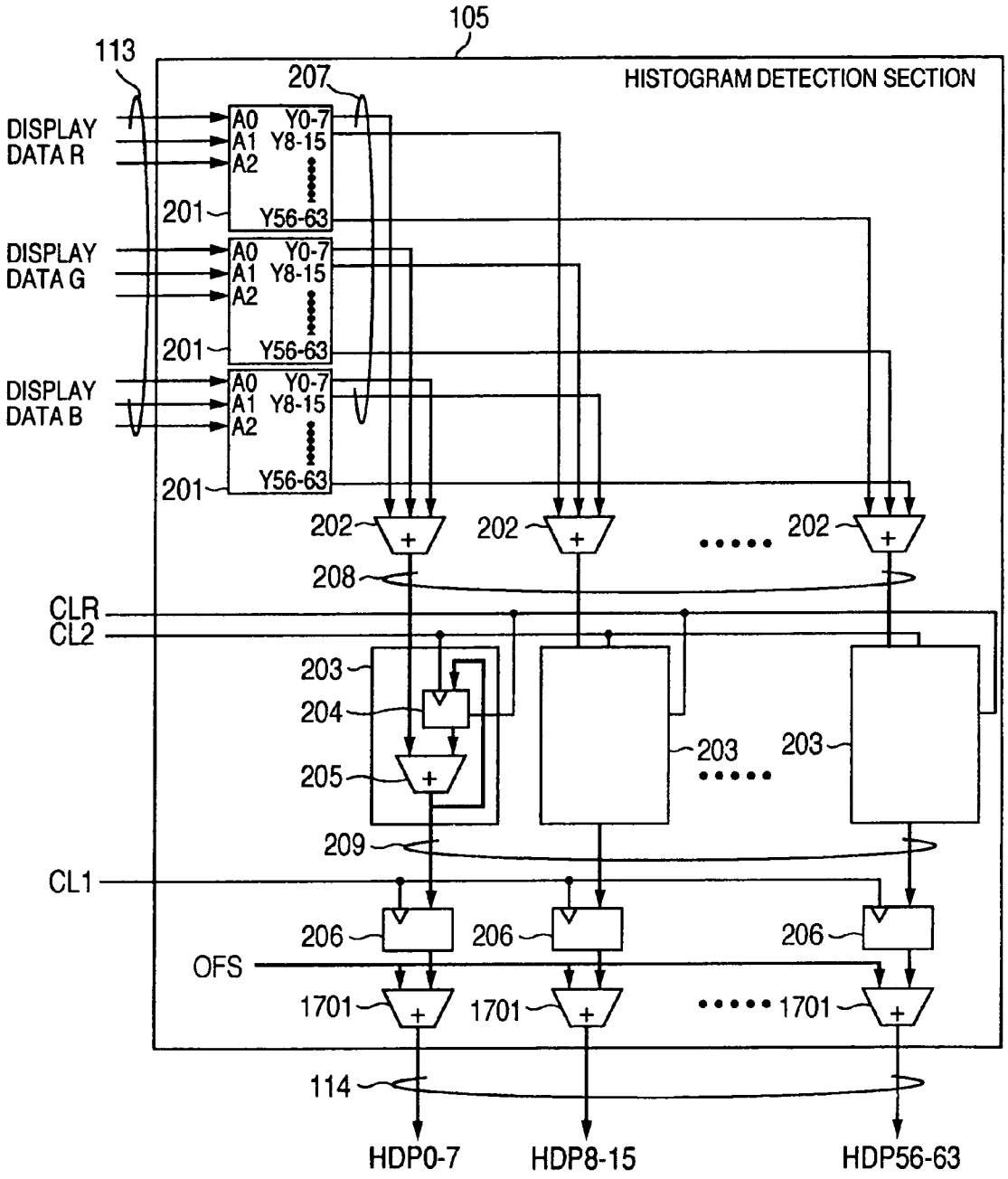
FIG. 17 is a diagram showing a configuration of a histogram detection section according to a sixth embodiment of the present invention.

First, a configuration of the histogram detection section 105 of the liquid crystal driving circuit 101 according to the present embodiment will now be described. In FIG. 17, numeral 1701 denotes an adder, and OFS denotes offset data. Other components are the same as those of the liquid crystal driving circuit of the first embodiment of the present invention and they are denoted by the same characters as those of FIG. 2. In the histogram detection 105 of the present embodiment, the offset data OFS has been added to the output data of the histogram detection section 105 of the first embodiment.

Figures 18, 19:
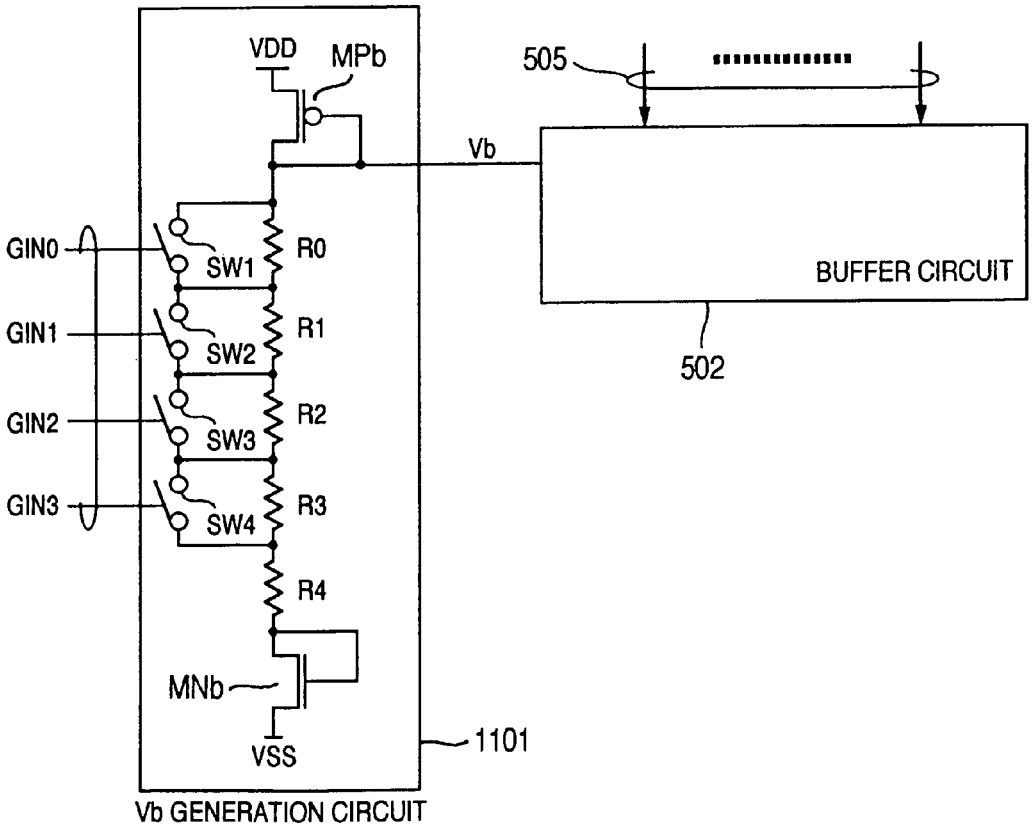
FIG. 18 is a diagram showing a configuration of a histogram detection section according to a sixth embodiment of the present invention and an effect of a gray-scale voltage generation section.
FIG. 19 is a diagram showing a configuration of a gray-scale voltage generation section according to a sixth embodiment of the present invention.

Operation of the histogram detection section 105 will now be described. As described above, the histogram detection section 105 reads out the display data 113 from the display memory 104 in accordance with the dot clock CL2, converts three bits of R, G and B of the display data 113 to eight decode signals 207 by using the decoders 201, converts the decode signals 207 to the addition data 208 of respective gray-scales by using the adders 202, integrates the addition data by using the counter circuits 203, and latches the integral values in the latches 206. In the histogram detection section 105 of the present embodiment, the offset data OFS is added to the latched data to generate the histogram data 114. In the present example, four high-order bits of the integral data are latched to generate the histogram data 114 as shown in FIG. 3. As a matter of course, it doesn't matter if all bits are latched. It is thus possible to analyze the histogram from the display data 113 and generate the histogram data proportionate to the number of display lines of each gray-scale. The offset data OFS will now be described. If the offset data OFS is "0h" as shown in FIG. 18, then the histogram data is the same as the latch data of the latch 206. When the frequency is in the range of 0 to 31, the histogram data becomes "0h". When the frequency is 384, the histogram data becomes "Ch". It is supposed at this time that the steady-state current quantity is 10 μA when the histogram data is "0h" and the steady-state current quantity increases by 10 μA every "1h". It is further supposed that the steady-state current quantity is 130 μA when the histogram data is "Ch" and the liquid crystal panel 121 (load) is driven thereby. When a liquid crystal panel 121 that is lighter in load than this liquid crystal panel 121 is connected, it can be sufficiently driven only with shortened charging and discharging periods. If a liquid crystal panel 121 having a larger load is connected, however, then the charging and discharging period become longer, and a predetermined voltage level is not reached in some cases. In the case where a liquid crystal panel 121 having a load of, for example, 1.2 times is connected, therefore, the offset data OFS is set to, for example, "3h". In this case, the histogram data becomes "3h" when the frequency is in the range of 0 to 31 and the histogram data becomes "Fh" when the frequency is 384. Since the steady-current is proportionate to the histogram data, the steady-current quantity becomes 40 μA when the histogram data is "3h" and the steady-current quantity becomes 160 μA when the histogram data is "Fh". Since this value is larger than 130 μA (maximum original current quantity)×1.2 (load increase factor of liquid crystal)=156 μA, the liquid crystal panel can be sufficiently driven. In this way, when the load is large, driving with an increased value of offset data OFS and consequently an increased output current is conducted to perform display. The present example has been described supposing that the histogram data has four bits. If the histogram data has five bits, the offset data OFS can be set to "13h" at most, and consequently various liquid crystal panels 121 can be coped with.

As another configuration for implementing the similar effects, a method of adjusting the bias voltage input to the buffer circuit is conceivable. Hereafter, the method will be described by referring to FIGS. 19 and 20.

First, in FIG. 19, the buffer circuit has basically the same configuration as that of the first embodiment shown in FIG. 6, and the Vb generation circuit basically has the same configuration as that of the third embodiment shown in FIG. 11. In the third embodiment, however, the Vb generation circuits are provided for the buffer circuits in one-to-one correspondence, whereas in the present embodiment only one Vb generation circuit is provided in common to buffer circuits in the same way as the first embodiment. Furthermore, the bias voltage Vb is controlled by the histogram data 115 in the third embodiment, whereas the bias voltage Vb is controlled by gain data GIN in the present embodiment.

Operation of the Vb generation circuit 1101 will now be described. A composite resistance of the resistors R0 to R4 connected in series is controlled by the gain data GIN. When the gain data GIN is "0h", all of the switches SW1 to SW4 turn off and the composite resistance becomes R4+R3+R2+R1+R0. When the gain data GIN is "Fh", all of the switches SW1 to SW4 turn on and the composite resistance becomes R4. In other words, the resistance value changes with the data weights of the gain data GIN. When the value of the gain data GIN is low, the bias voltage Vb becomes high and the bias current value of the buffer circuit 502 becomes small. When the value of the gain data GIN is high, the bias voltage Vb becomes low and the bias current value of the buffer circuit 502 becomes large. The resistors R0 to R4 are set so as to increase the bias current by 0.125 times each time the value of the gain data GIN increases by one. For example, if "7h" is taken as one time and regarded as reference and "9h" is taken as 1.25 times, then steady-state currents shown in FIG. 20 are obtained for "7h" and "9h" and an effect similar to that of the method of adding the offset data OFS described earlier is brought about. In the case where the load is large, therefore, it is possible to drive the load with an increased value of the gain data GIN and consequently an increased bias current.

The offset data OFS and the gain data GIN can be generated by terminal setting of the liquid crystal driving circuit 101 or by transferring setting information from the CPU 119 and providing a register for storing the information. The methods of setting the offset data OFS and the gain data GIN can also be used in combination.

Seventh Embodiment

Hereafter, an operation of a histogram detection section and a gray-scale voltage generation section of a liquid crystal driving circuit according to a seventh embodiment of the present invention will be described by referring to FIGS. 21 to 24. The present embodiment has a feature that the steady-state current values in the stable period are made lower as compared with the charging and discharging period with the object of further reducing the power consumption of the liquid crystal driving circuit according to the sixth embodiment.

A configuration of the liquid crystal driving circuit 101 according to the present embodiment is the same as the configuration of the liquid crystal driving circuit 101 of the sixth embodiment except how to give the offset data OS or the gain data GIN.

Figure 21:
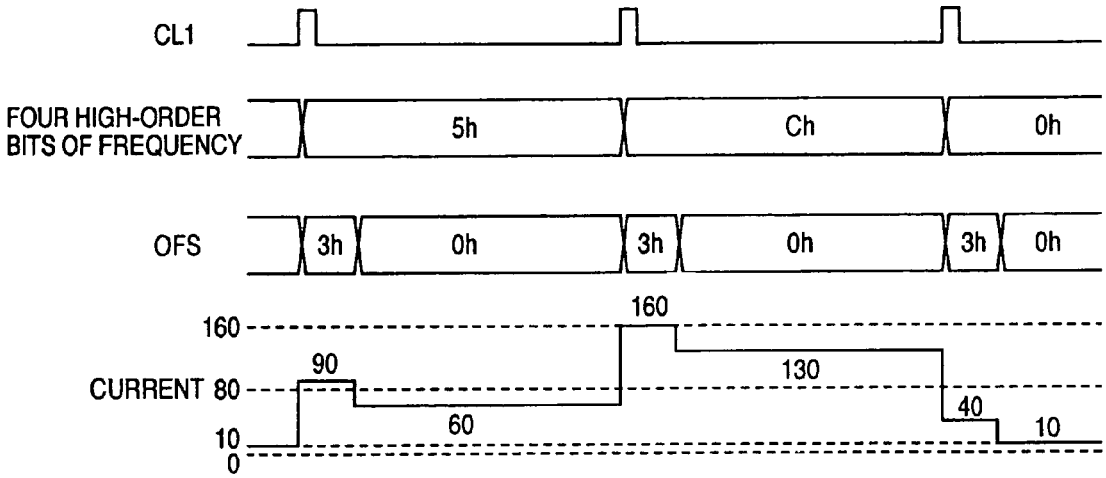
FIG. 21 is a diagram showing a configuration of a histogram detection section and operation and an effect of a gray-scale voltage generation section according to a seventh embodiment of the present invention.
Figure 22:
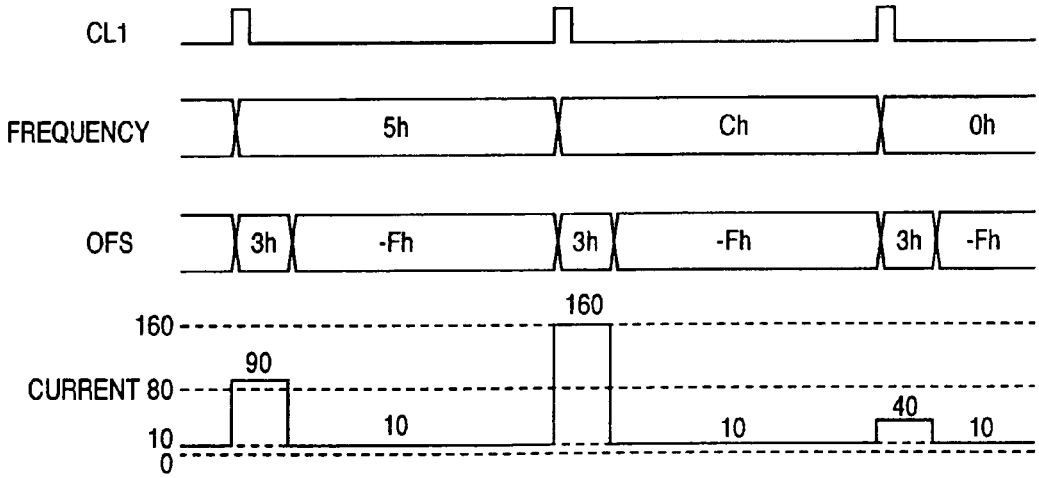
FIG. 22 is a diagram showing a configuration of a histogram detection section and operation and an effect of a gray-scale voltage generation section according to a seventh embodiment of the present invention.

First, how to give the offset data OFS will now be described by referring to FIG. 21. As exemplified in the sixth embodiment, it is supposed that the buffer circuit 502 has a steady-state current quantity of 10 μA when the histogram data is "0h". It is further supposed that the steady-state current quantity increases by 10 μA every "1h" and the steady-state current quantity becomes 130 μA when the histogram data is "Ch". And it is supposed that the histogram data of a certain gray-scale changes from "5h" to "Ch", then to "0h" in synchronism with the clock CL1. At this time, operation is conducted so that the offset data OFS will become "3h" during only a first period of the line that is the charging and discharging period and become "0h" in the stable period. When the histogram data is "5h", therefore, the steady-state current quantity becomes 90 μA in the charging and discharging period and becomes 60 μA in the stable period. In other words, in a liquid crystal panel 121 having a large load as described with reference to the sixth embodiment, a required current is output during only the charging and discharging period, whereas in the stable period only the current required when driving a liquid crystal panel 121 having a small load is flown. In the stable period, the liquid crystal panel 121 consumes little current, and consequently there is no problem even if the output current is suppressed. In addition, a negative number may be used as the offset data OFS. However, the adder 1701 shown in FIG. 17 must correspond to addition of negative numbers. Furthermore, the buffer circuit 502 corresponds to only an integer of at least 0. In the case where a result of addition in the adder 1701 becomes a negative number, it must be rounded to 0. This example is shown in FIG. 22. Operation is conducted so that the offset data OFS will become "3h" during only a first period of the line that is the charging and discharging period and become "−Fh" in the stable period. When the histogram data is "5h", therefore, the steady-state current quantity becomes 90 μA in the charging and discharging period, and becomes 10 μA in the stable period, because a result of addition conducted by the adder 310 becomes a negative number and it is rounded to 0. In the stable period, the liquid crystal panel 121 consumes little current, and consequently in this case as well there is no problem even if the output current is suppressed.

As heretofore described, the power consumption can be reduced by the operation of the offset data OFS of the liquid crystal driving circuit 101 according to the present embodiment.

Figure 23:
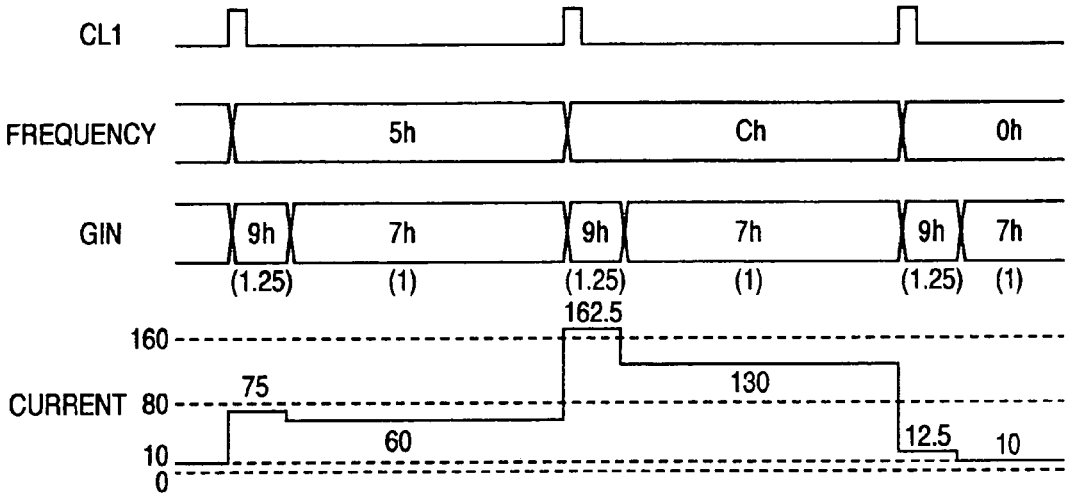
FIG. 23 is a diagram showing operation and an effect of a gray-scale voltage generation section according to a seventh embodiment of the present invention.

How to give the gain data GIN will now be described by referring to FIG. 23. First, it is supposed that the histogram data of a certain gray-scale changes from "5h" to "Ch", then to "0h" in synchronism with the clock CL1. And operation is conducted so that the gain data GIN will become "9h" during only a first period of the line that is the charging and discharging period and become "7h" in the stable period. When the frequency is "5h", therefore, the steady-state current quantity becomes 75 μA in the charging and discharging period and becomes 60 μA in the stable period. In other words, in a liquid crystal panel 121 having a large load as described with reference to the sixth embodiment, a required current is output during only the charging and discharging period, whereas in the stable period only the current required when driving a liquid crystal panel 121 having a small load is flown. In the stable period, the liquid crystal panel 121 consumes little current, and consequently there is no problem even if the output current is suppressed.

Figure 24:
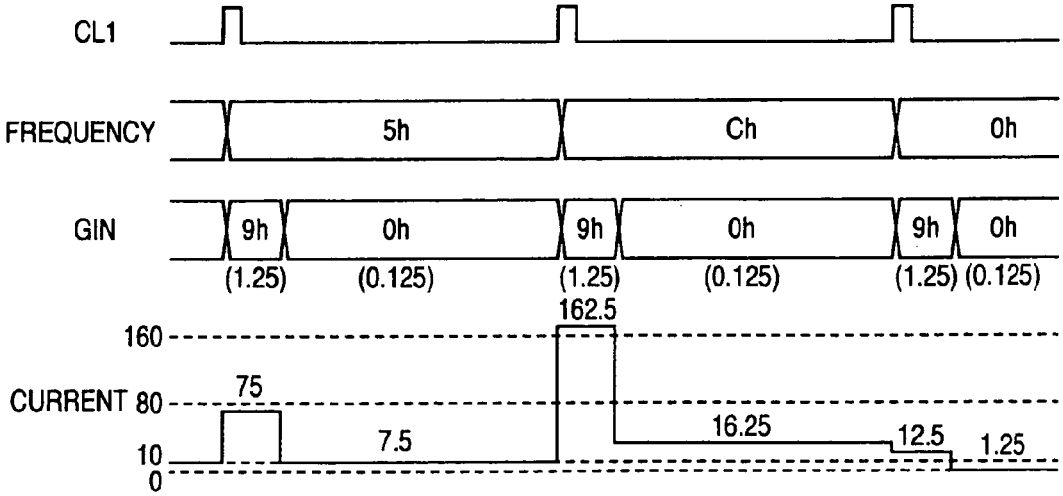
FIG. 24 is a diagram showing another operation and an effect of a gray-scale voltage generation section according to a seventh embodiment of the present invention.

In addition, the gain data GIN may be minimized and used. This example is shown in FIG. 24. Operation is conducted so that the gain data GIN will become "9h" during only a first period of the line that is the charging and discharging period and become "0h" in the stable period. When the histogram data is "5h", therefore, the steady-state current quantity becomes 75 μA in the charging and discharging period, and becomes 7.5 μA in the stable period, because the current becomes 0.125 times as compared with the standard value. In the stable period, the liquid crystal panel 121 consumes little current, and consequently in this case as well there is no problem even if the output current is suppressed.

As heretofore described, the power consumption can be reduced by the operation of the gain data GIN of the liquid crystal driving circuit 101 according to the present embodiment.

By the way, the aforementioned switchover schemes of the offset data OFT and the gain data GIN can also be used in combination.

The present invention is not limited to the embodiments heretofore described. It is a matter of course that various changes are made without departing from the spirit. For example, in the buffer circuit described with reference to FIG. 6, PMOS transistors are coupled so as to form a source pair. Even in a buffer circuit having NMOS transistors coupled so as to form a source pair, however, low power consumption can be realized by conducting the histogram detection of the display data in the same way and reflecting the result to the output current quantity of the gray-scale voltage generation section. Furthermore, the switchover method of the steady-current in one horizontal scanning interval shown in the seventh embodiment of the present invention may be implemented by a method other than the method using the offset data OFT and the gain data GIN. Furthermore, it may be carried out singly apart from the steady-state current control using the histogram, which is the main subject of the present invention.

Furthermore, the embodiments have been described by taking a liquid crystal panel as an example. However, the embodiments are not limited to this, but the embodiments can be applied to, for example, organic EL panels, plasma displays, and so on as well.

What is claimed is:

1. A display device for displaying display data, comprising:

a display panel having pixel sections in a matrix form;

a scanning circuit which selects a line of the pixel sections;

a generation circuit which generates a plurality of gray-scale voltages based on a reference voltage; and a selection circuit which selects a gray-scale voltage corresponding to the display data from the plurality of gray-scale voltages, and outputs the gray-scale voltage thus selected to a pixel section of the display panel;

wherein the generation circuit one of increases a steady-state current of the generation circuit at a charging and discharging period of the display panel, and decreases the steady-state current of the generation circuit at a stable period of the display panel within one scanning period of the scanning circuit, the steady-state current of the generation circuit being controlled based on a histogram of the display data so as to be increased or decreased by adding or subtracting offset data, having been set by a register, from the histogram of the display data within the one scanning period of the scanning circuit.

2. A display device according to claim 1, for displaying display data, comprising:

a display panel having pixel sections in a matrix form;

a scanning circuit which provides at least a first period and a second period within one scanning period, and which selects a line of the pixel sections;

a generation circuit which generates a plurality of gray-scale voltages based on a reference voltage; and a selection circuit which selects a gray-scale voltage corresponding to the display data from the plurality of gray-scale voltages, and outputs the gray-scale voltage thus selected to a pixel section of the display panel;

wherein the generation circuit one of increases a steady-state current of the generation circuit at the second period within the one scanning period of the scanning circuit; and wherein the generation circuit controls the steady-state current of the generation circuit based on a histogram of the display data, and the generation circuit changes the steady-state current of the generation circuit by changing offset data added to or subtracted from the histogram of the display data within the one scanning period of the scanning circuit.

3. The display device according to claim 2, further comprising a register for setting the offset data from an external device.

4. A display device for displaying display data, comprising:

a display panel having pixel sections in a matrix form;

a scanning circuit which provides at least a first period and a second period within one scanning period, and which selects a line of the pixel sections;

a generation circuit which generates a plurality of gray-scale voltages based on a reference voltage; and a selection circuit which selects a gray-scale voltage corresponding to the display data from the plurality of gray-scale voltages, and outputs the gray-scale voltage thus selected to a pixel section of the display panel;

wherein the generation circuit one of increases a steady-state current of the generation circuit at the second period within the one scanning period of the scanning circuit; and wherein the generation circuit includes a buffer circuit for buffering the reference voltage, and a divider circuit for dividing the reference voltage thus buffered to output the plurality of gray-scale voltages, and the generation circuit changes the steady-state current of the generation circuit by changing gain data for amplifying a current value of the buffer circuit within the one scanning period of the scanning circuit.

5. The display device according to claim 4, further comprising a register for setting the gain data from an external device.

6. A display device for displaying display data, comprising:

a display panel having pixel sections in a matrix form;

a scanning circuit which selects a line of the pixel sections;

a generation circuit which generates a plurality of gray-scale voltages based on a reference voltage; and a selection circuit which selects a gray-scale voltage corresponding to the display data from the plurality of gray-scale voltages, and outputs the gray-scale voltage thus selected to a pixel section of the display panel;

wherein a steady-state current of the generation circuit at a first period within one scanning period of the scanning circuit is greater than a steady-state current of the generation circuit at a second period within the one scanning period of the scanning circuit, the steady-state current of the generation circuit being controlled based on a histogram of the display data so as to be increased or decreased by adding or subtracting offset data, having been set by a register, from the histogram of the display data within the one scanning period of the scanning circuit.

7. A display device for displaying display data, comprising:

a display panel having pixel sections in a matrix form;

a scanning circuit which selects a line of the pixel sections;

a generation circuit which generates a plurality of gray-scale voltages based on a reference voltage; and a selection circuit which selects a gray-scale voltage corresponding to the display data from the plurality of gray-scale voltages, and outputs the gray-scale voltage thus selected to a pixel section of the display panel;

wherein a steady-state current of the generation circuit at a charging and discharging period of the display panel within one scanning period of the scanning circuit is greater than a steady-state current of the generation circuit at a stable period of the display panel within the one scanning period of the scanning circuit, the steady-state current of the generation circuit being controlled based on a histogram of the display data so as to be increased or decreased by adding or subtracting offset data, haying been set by a register, from the histogram of the display data within the one scanning period of the scanning circuit.

* * * * *